US009597694B2

(12) United States Patent
Bosua

(10) Patent No.: US 9,597,694 B2
(45) Date of Patent: Mar. 21, 2017

(54) PNEUMATIC PORTED ATOMIZING FLUID DELIVERY MANIFOLD

(71) Applicant: Tornaditech LLC, Austin, TX (US)

(72) Inventor: Christopher Bosua, Orlando, FL (US)

(73) Assignee: Tornadatech LLC, Austin, TX (US)

( * ) Notice: Subject to any disclaimer, the term of this patent is extended or adjusted under 35 U.S.C. 154(b) by 0 days.

(21) Appl. No.: 14/798,710

(22) Filed: Jul. 14, 2015

(65) Prior Publication Data

US 2017/0014839 A1 Jan. 19, 2017

(51) Int. Cl.

*B05B 3/06* (2006.01)
*B05B 7/04* (2006.01)
*B05B 7/08* (2006.01)

(52) U.S. Cl.

CPC ..... *B05B 3/06* (2013.01); *B05B 7/0416* (2013.01); *B05B 7/0869* (2013.01)

(58) Field of Classification Search

CPC ..... B05B 3/06; B05B 7/0416; B05B 7/061; B05B 7/0869; B05B 7/0892; B05B 3/0427; B05B 7/2435; B08B 3/026

USPC .... 239/225.1, 226, 251, 293, 310, 418, 423, 239/424, 433, 549, 588, 229, 318, 416.5

See application file for complete search history.

(56) References Cited

U.S. PATENT DOCUMENTS 8,920,133 B2 12/2014 Bosua
2009/0057443 A1* 3/2009 Sendo ..... B05B 3/022 239/405
2010/0320289 A1* 12/2010 Kuo ..... B05B 3/022 239/290
2012/0286065 A1* 11/2012 Lin ..... B05B 3/0409 239/225.1
2012/0286071 A1* 11/2012 Lin ..... B05B 3/06 239/525
2014/0008457 A1* 1/2014 Bosua ..... B05B 15/025 239/104
2014/0061334 A1* 3/2014 Liao ..... B05B 3/00 239/315

FOREIGN PATENT DOCUMENTS

EP 2255885 A1 12/2010

* cited by examiner

*Primary Examiner* — Arthur O Hall
*Assistant Examiner* — Cody Lieuwen
(74) *Attorney, Agent, or Firm* — Michael G. Smith, Esq.

(57) ABSTRACT

Systems, methods and apparatus are provided through which in some implementations a pneumatic ported atomizing fluid delivery manifold includes a fluid delivery housing, the fluid delivery housing having a frustum geometry, the fluid delivery housing has a first end and a second end, the first end has a first plane and the second end having a second plane, the fluid delivery housing has at least one chamber through which cleaning solution is operable to pass from the first end to the second end, and a free-floating pneumatic rotating exit tube positioned along a longitudinal center axis of the fluid delivery housing, the free-floating pneumatic rotating exit tube have only air passing through the free-floating pneumatic rotating exit tube.

9 Claims, 40 Drawing Sheets

FREE-FLOATING PNEUMATIC ROTATING EXIT TUBE 110

FREE-FLOATING PNEUMATIC ROTATING EXIT TUBE 110

FREE-FLOATING PNEUMATIC ROTATING EXIT TUBE 110

FREE-FLOATING PNEUMATIC ROTATING EXIT TUBE 110

FREE-FLOATING PNEUMATIC ROTATING EXIT TUBE 110

FREE-FLOATING PNEUMATIC ROTATING EXIT TUBE 110

FREE-FLOATING PNEUMATIC ROTATING EXIT TUBE 110

FREE-FLOATING PNEUMATIC ROTATING EXIT TUBE 110

BEARING SPACER 2000

BEARING SPACER 2000

BEARING SPACER 2000

INNER TUBE NUT 2400

INNER TUBE NUT 2400

INNER TUBE NUT 2400

INNER TUBE NUT 2400

PNEUMATIC PORTED ATOMIZING ASSEMBLY 102

PNEUMATIC PORTED ATOMIZING ASSEMBLY 102

PNEUMATIC PORTED ATOMIZING ASSEMBLY 102

PNEUMATIC PORTED ATOMIZING ASSEMBLY 102

PNEUMATIC PORTED ATOMIZING ASSEMBLY 102

PNEUMATIC PORTED FLUID DELIVERY MANIFOLD 104

PNEUMATIC PORTED FLUID DELIVERY MANIFOLD 104

PNEUMATIC PORTED FLUID DELIVERY MANIFOLD 104

PNEUMATIC PORTED FLUID DELIVERY MANIFOLD 104

PNEUMATIC PORTED FLUID DELIVERY MANIFOLD 104

PNEUMATIC PORTED FLUID DELIVERY MANIFOLD 104

PNEUMATIC PORTED ATOMIZING FLUID DELIVERY MANIFOLD

FIELD

This disclosure relates generally to cleaning devices, and more particularly to rotary spray guns.

BACKGROUND

Conventional pneumatic rotational cleaning tool nose cones typically require frequent maintenance in which an inner fluid tube of the pneumatic rotating exit tube is replaced. The inner fluid tube is a tube that is positioned in an inner cavity of the pneumatic rotating exit tube. As described in FIG. 5 of patent EP 2255885, when the user presses a control lever of the spray gun, a flow of compressed air or fluid is forced into a barrel through an intake port. The intake flow of compressed air or fluid is then guided through an inner fluid tube that is in an elongated tubular body portion and curved nozzle tip of the pneumatic rotating exit tube to an outside of the inside wall of the fluid delivery housing. When the high speed flow of compressed air of fluid is flowing through the connection area between the elongated tubular body portion and the curved nozzle tip of the pneumatic rotating exit tube an eccentric force is produced, causing rotation of the pneumatic rotating exit tube relative to the fluid delivery housing and therefore the output flow of compressed air or fluid is forced out of the orifice of the fluid delivery housing mist of fine drops of fluid, in the case that compressed fluid is forced through the intake port into the barrel. Significantly, the inner fluid tube is thrown-about chaotically within the atomizer. The friction between the inner fluid tube and the pneumatic rotating exit tube causes sufficient wear on the inner fluid tube to require replacement of the inner fluid tube after approximately 300 hours of operation.

BRIEF DESCRIPTION

The above-mentioned shortcomings, disadvantages and problems are addressed herein, which will be understood by reading and studying the following specification.

In one aspect, a pneumatic ported atomizing fluid delivery manifold includes a fluid delivery housing, the fluid delivery housing having a frustum geometry, the fluid delivery housing having a first end and a second end, the first end have a first plane and the second end having a second plane, the fluid delivery housing having at least one chamber through which cleaning solution is operable to pass from the first end to the second end, and a free-floating pneumatic rotating exit tube positioned along a longitudinal center axis of the fluid delivery housing, the free-floating pneumatic rotating exit tube have only air passing through the free-floating pneumatic rotating exit tube.

In a further aspect, a pneumatic ported atomizing fluid delivery manifold including a fluid delivery housing, the fluid delivery housing having a frustum geometry, the fluid delivery housing having a first end and a second end, the first end have a first plane and the second end having a second plane, the fluid delivery housing having at least one chamber through which cleaning solution is operable to pass from the first end to the second end, and a free-floating pneumatic rotating exit tube positioned along a longitudinal center axis of the fluid delivery housing and the free-floating pneumatic rotating exit tube having no inner fluid tube within the free-floating pneumatic rotating exit tube, the free-floating pneumatic rotating exit tube have only air passing through the free-floating pneumatic rotating exit tube.

In another aspect, a pneumatic ported atomizing fluid delivery manifold includes a fluid delivery housing, the fluid delivery housing having a frustum geometry, the fluid delivery housing having a first end and a second end, the first end have a first plane and the second end having a second plane, the fluid delivery housing having plurality of chambers through which cleaning solution is operable to pass from the first end to the second end, and a free-floating pneumatic rotating exit tube positioned along a longitudinal center axis of the fluid delivery housing and the free-floating pneumatic rotating exit tube having no inner fluid tube within the free-floating pneumatic rotating exit tube, the free-floating pneumatic rotating exit tube have only air passing through the free-floating pneumatic rotating exit tube, wherein the plurality of chambers that also includes the plurality of chambers being positioned radially and symmetrically in the fluid delivery housing around a center longitudinal axis of the fluid delivery housing, wherein each of the plurality of chambers that also includes an entry chamber positioned at the first end of the fluid delivery housing, an intermediate chamber positioned between the first end and the second end of the fluid delivery housing, the intermediate chamber operably coupled to the entry chamber, and an exit chamber positioned at the second end of the fluid delivery housing, the exit chamber operably coupled to the intermediate chamber.

Apparatus, systems, and methods of varying scope are described herein. In addition to the aspects and advantages described in this summary, further aspects and advantages will become apparent by reference to the drawings and by reading the detailed description that follows.

DETAILED DESCRIPTION

In the following detailed description, reference is made to the accompanying drawings that form a part hereof, and in which is shown by way of illustration specific implementations which may be practiced. These implementations are described in sufficient detail to enable those skilled in the art to practice the implementations, and it is to be understood that other implementations may be utilized and that logical, mechanical, electrical and other changes may be made without departing from the scope of the implementations. The following detailed description is, therefore, not to be taken in a limiting sense.

The detailed description is divided into four sections. In the first section, apparatus of implementations are described. In the second section, implementations of methods are described. Finally, in the third section, a conclusion of the detailed description is provided.

Apparatus Implementations

In this section, particular apparatus are described by reference to a series of diagrams.

Figure 1:
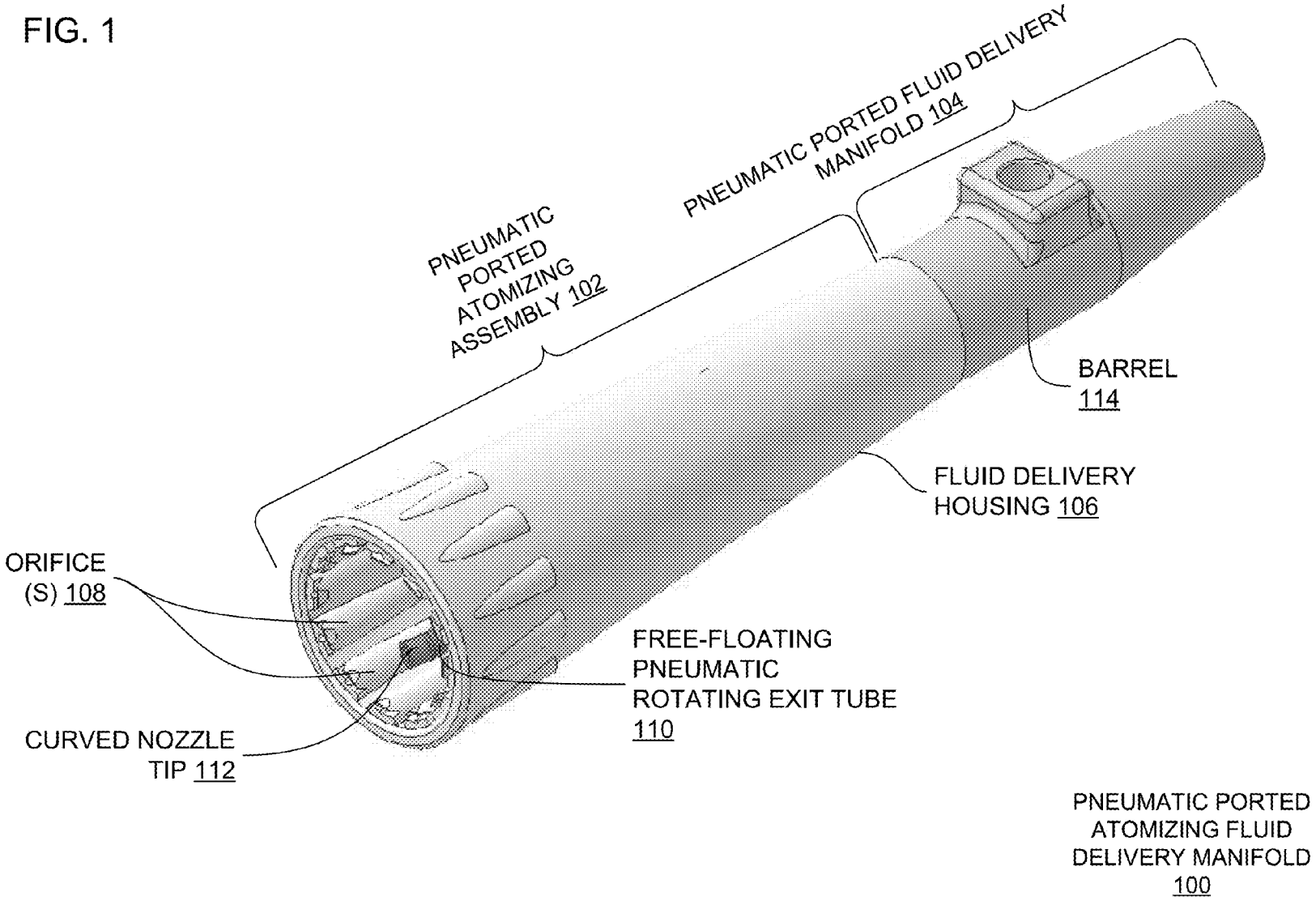
FIG. 1 is an isometric diagram of a pneumatic ported atomizing fluid delivery manifold, according to an implementation.

FIG. 1 is an isometric diagram of a pneumatic ported atomizing fluid delivery manifold 100, according to an implementation. Pneumatic ported atomizing fluid delivery manifold 100 includes a pneumatic ported atomizing assembly 102 and a pneumatic ported fluid delivery manifold 104. The pneumatic ported atomizing assembly 102 includes a fluid delivery housing 106. The fluid delivery housing 106 is a hollow cylindrical member having one end thereof terminating in orifices(s) 108. The orifices(s) 108 are a cavity in the fluid delivery housing 106. The fluid delivery housing 106 is also known as a housing.

The free-floating pneumatic rotating exit tube 110 is mounted in the fluid delivery housing 106 and includes a curved nozzle tip 112 that is obliquely extended at an angle inside the fluid delivery housing 106 in proximity to the orifices(s) 108. The pneumatic ported fluid delivery manifold 104 is attached onto the pneumatic ported atomizing assembly 102 on the opposite side of the orifices(s) 108. The pneumatic ported fluid delivery manifold 104 includes a barrel 114.

Figure 2:
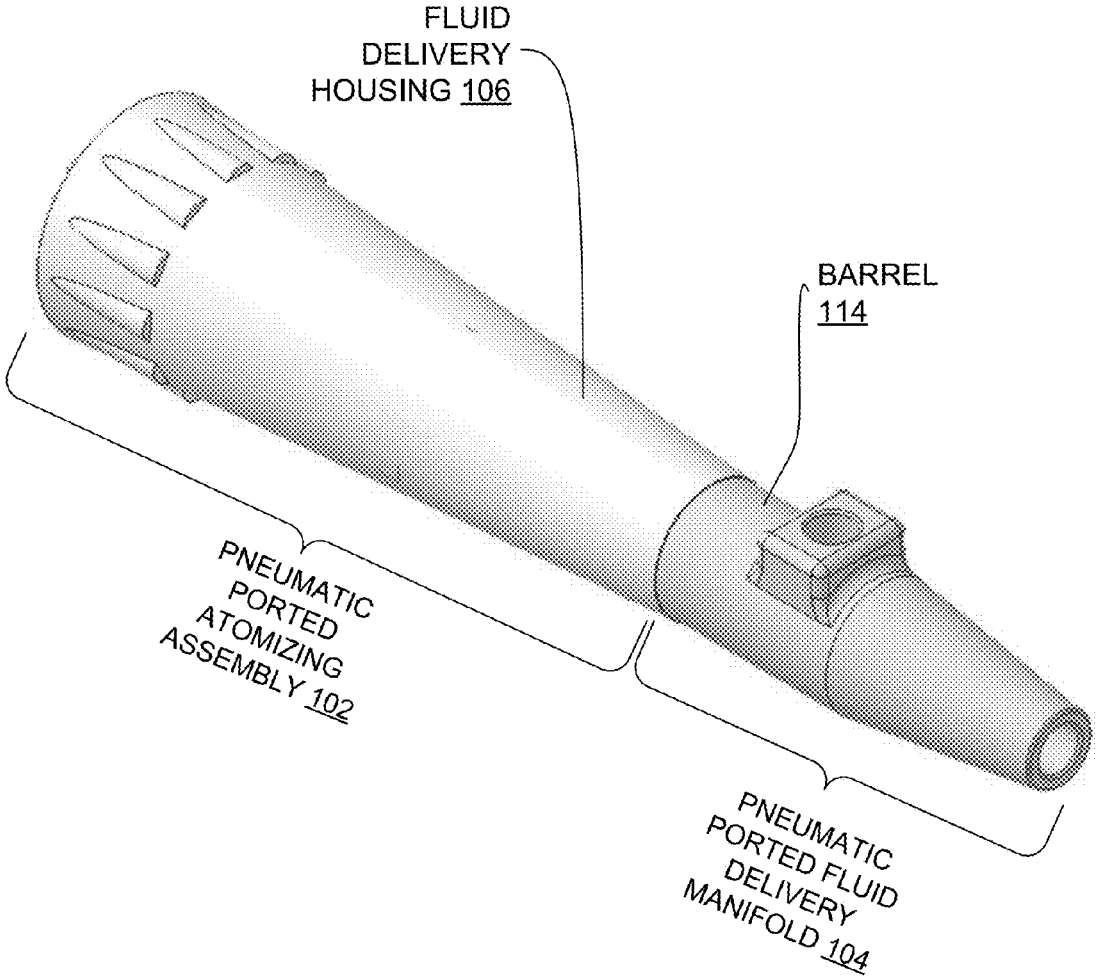
FIG. 2 is an isometric diagram of a pneumatic ported atomizing fluid delivery manifold, according to an implementation.

FIG. 2 is an isometric diagram of a pneumatic ported atomizing fluid delivery manifold 100, according to an implementation. Pneumatic ported atomizing fluid delivery manifold 100 includes pneumatic ported atomizing assembly 102 for rotary spray gun in accordance with an implementation is shown that includes a pneumatic ported atomizing assembly 102 and a pneumatic ported fluid delivery manifold 104. The pneumatic ported atomizing assembly 102 includes a fluid delivery housing 106 which is a hollow cylindrical member. The pneumatic ported fluid delivery manifold 104 is attached to the pneumatic ported atomizing assembly 102 on the opposite side of the orifices(s) 108.

Figure 3:
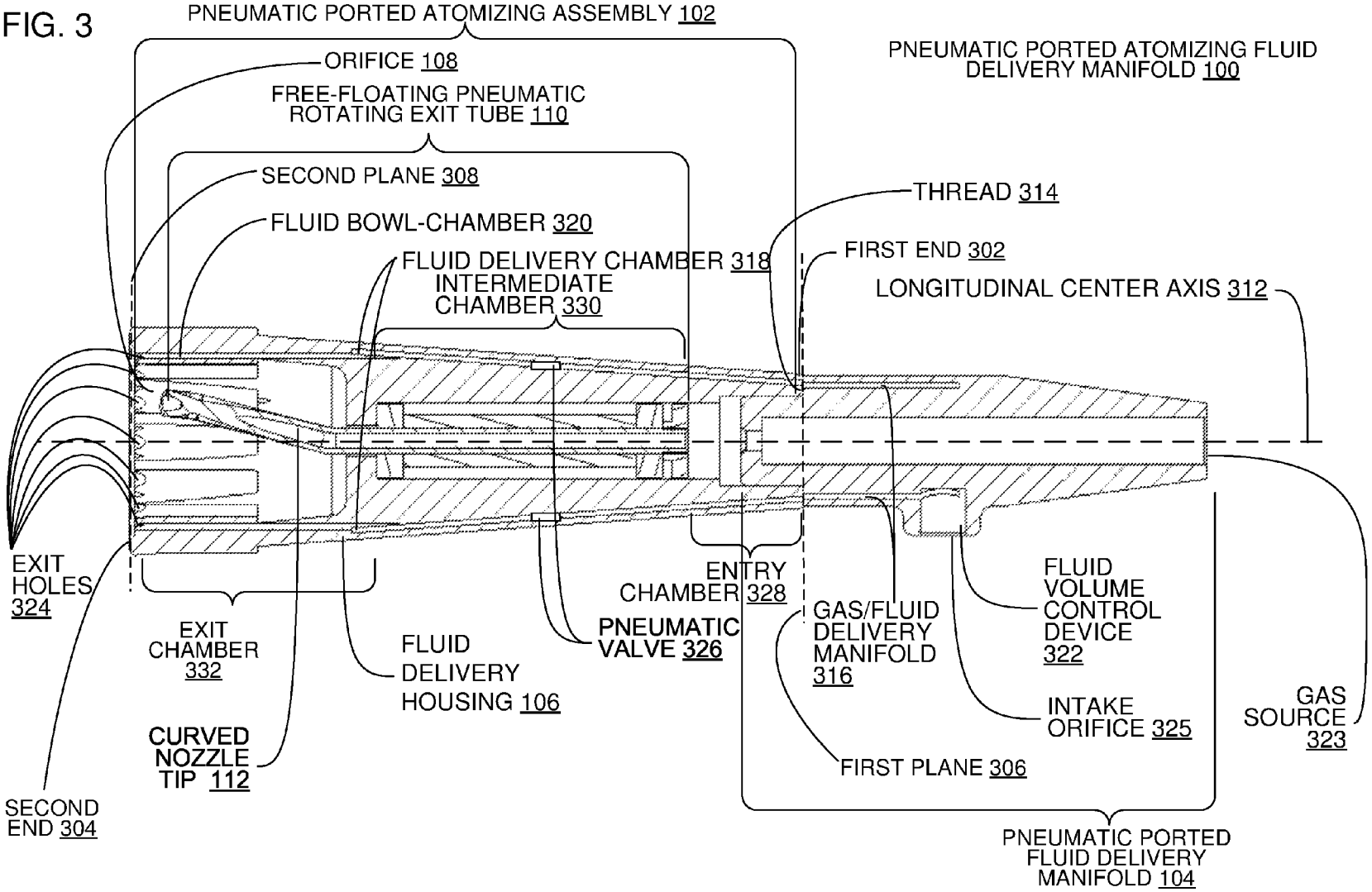
FIG. 3 is a side view of an isometric diagram of a pneumatic ported atomizing fluid delivery manifold, according to an implementation.

FIG. 3 is a side view of an isometric diagram of a pneumatic ported atomizing fluid delivery manifold 100, according to an implementation. The pneumatic ported atomizing fluid delivery manifold 100 includes the pneumatic ported atomizing assembly 102 and the pneumatic ported fluid delivery manifold 104.

The pneumatic ported atomizing assembly 102 includes a fluid delivery housing 106 which is a hollow cylindrical member. The fluid delivery housing 106 has a first end 302 and a second end 304. The first end 302 has a first plane 306 and the second end 304 has a second plane 308. The fluid delivery housing 106 has plurality of chambers 310 which are operable to pass a fluid (such as a cleaning solution) or a gas from the first end 302 to the second end 304. The chambers 310 also provide storage for the fluid in the pneumatic ported atomizing assembly 102. In the implementation shown in FIG. 3, the chambers 310 are positioned radially and symmetrically in the fluid delivery housing 106 around a center longitudinal axis 312 of the fluid delivery housing 106. In the implementation shown in FIG. 3, at least one of the plurality of chambers 310 is positioned above the center longitudinal axis 312 to an extent that gravity is operable to draw the fluid out of the plurality of chambers 310 that are above the center longitudinal axis 312 through the second end 304.

The fluid delivery housing 106 is connected to the pneumatic ported fluid delivery manifold 104, via a thread 314, but not limited to the thread 314. The pneumatic ported fluid delivery manifold 104 includes a gas/fluid delivery manifold 316.

The chambers 310 in the fluid delivery housing 106 include a gas/fluid delivery chamber 318 and a fluid bowl-chamber 320. The gas delivered by a gas delivery source 323 can be air. One end of the gas/fluid delivery chamber 318 is connected to the fluid bowl-chamber 320 and the fluid bowl-chamber 320 connects to exit holes 324.

The gas/fluid delivery manifold 316 in the pneumatic ported fluid delivery manifold 104 provides a passageway to deliver the fluid to the gas/fluid delivery chamber 318 in the pneumatic ported atomizing assembly 102. A fluid volume control device 322 in the pneumatic ported fluid delivery manifold 104 is able to adjust an amount of the fluid that is delivered to the gas/fluid delivery manifold 316 and ultimately to the exit holes 324. The fluid volume control device 322 includes a fluid intake orifice 325 through which the fluid enters the fluid volume control device 322 of the pneumatic ported fluid delivery manifold 104 of the pneumatic ported atomizing fluid delivery manifold 100. In some implementations an apparatus that stores the fluid can be connected to the fluid volume control device 322.

The gas from the gas source 323 passes through a central cavity (3802 in FIG. 38) of the pneumatic ported fluid delivery manifold 104 and through a central cavity (602 in FIG. 6) of the pneumatic ported atomizing assembly 102 to the free-floating pneumatic rotating exit tube 110 and out the curved nozzle tip 112 of the free-floating pneumatic rotating exit tube 110. The angle of the curved nozzle tip relative to the longitudinal axis 312 has the effect of exhausting the gas at an oblique angle to the longitudinal axis 312 which propels the free-floating pneumatic rotating exit tube 110 in rotation, causing the fluid to be expelled outward and backward from the second plane 308. At the exit holes 324 of the orifice(s) 108, the fluid from the exit holes 324 and the gas from the free-floating pneumatic rotating exit tube 110 are mixed together creating a fine mist of high pressure gas and fluid in a rotational motion. The volume of the fluid from the gas/fluid delivery chamber 318 to the fluid bowl-chamber 320 can be switched on and off and varied by the pneumatic valve 326 that is fitted internally in the pneumatic ported atomizing assembly 102 and thus the force, speed and volume of the fluid from the exit holes 324 can be switched on and off and varied by the pneumatic valve 326. The pneumatic ported atomizing assembly 102 includes and entry chamber 328, and intermediate chamber 330 and an exit chamber 332.

Conventional pneumatic rotational cleaning tools cannot be used with a fluid that contains substances such as wax/soap/foam/silicon/tire clear that are undiluted because these substances have a very high viscosity level and weight, which do not pass through the conventional pneumatic rotational cleaning tools easily at normal pressure. The conventional solution to this problem is to dilute the substances at a 8-1 ratio, but the dilution reduces the effectiveness of the substances. In comparison, the chambers 310 of the pneumatic ported atomizing fluid delivery manifold 100 being closer to the second end 304 of the fluid delivery housing 106 leaves no limits to the substances that can be passed through the chambers 310 and out the exit holes 324 for use without dilution in the fluid in the pneumatic ported atomizing assembly 102. More specifically, the chambers 310, exit holes 324 and the pneumatic ported atomizing assembly 102 do not require the dilution of the substances, which greatly improves the effectiveness of the substances.

The multiple exit holes 324 reduces the chance that one of the exit holes being blocked will block all movement of the fluid, which also reduces the chance that two or three of the exit holes 324 being blocked will block all movement of the fluid. The multiple exit holes 324 are also easier to clean blockages. In comparison, conventional pneumatic rotational cleaning tools require disassembly of the entire tool and replacement of the inner fluid tube and then reassembly of the entire tool just, for a simple blockage. In addition, the clear passages of chambers 310 and the exit holes 324 for the air/gas/fluid to flow through from the first end 302 of the pneumatic ported atomizing assembly 102 to the exit holes 324 requires less air pressure to deliver the same air volume to produce more exit air power at the exit holes 324, thus, a smaller air compressor is needed to operate the pneumatic ported atomizing fluid delivery manifold 100.

Figure 4:
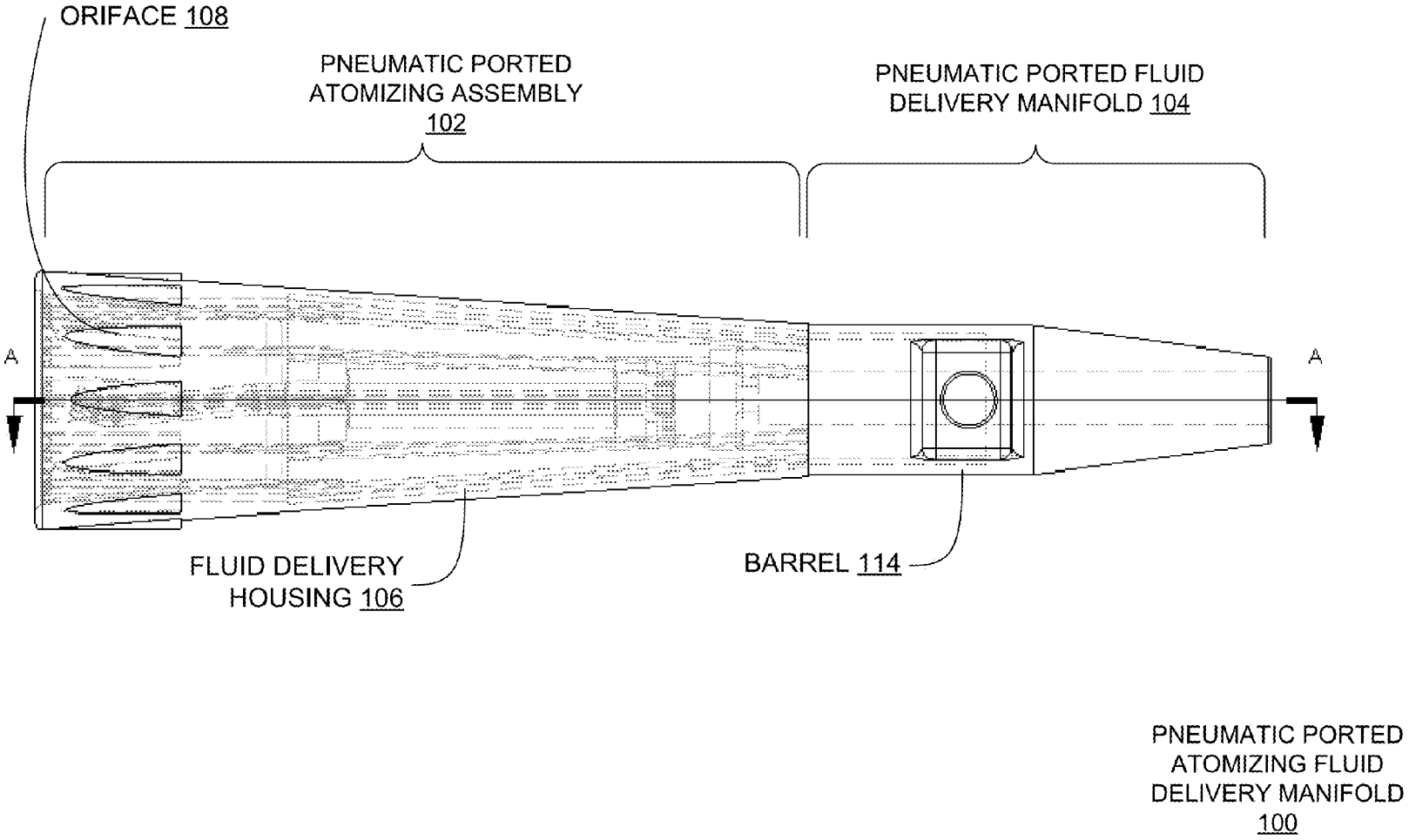
FIG. 4 is a top view of an isometric diagram of a pneumatic ported atomizing fluid delivery manifold, according to an implementation.

FIG. 4 is a top view of an isometric diagram of a pneumatic ported atomizing fluid delivery manifold 100, according to an implementation. Pneumatic ported atomizing fluid delivery manifold 100 includes pneumatic ported atomizing assembly 102 for rotary spray gun in accordance with an implementation is shown that includes a pneumatic ported atomizing assembly 102 and a pneumatic ported fluid delivery manifold 104. The pneumatic ported atomizing assembly 102 includes a fluid delivery housing 106 which is a hollow cylindrical member having one end thereof terminating in orifices(s) 108. The pneumatic ported fluid delivery manifold 104 is attached to the pneumatic ported atomizing assembly 102 on the opposite side of the orifices(s) 108. The pneumatic ported fluid delivery manifold 104 includes a barrel 114.

Figure 5:
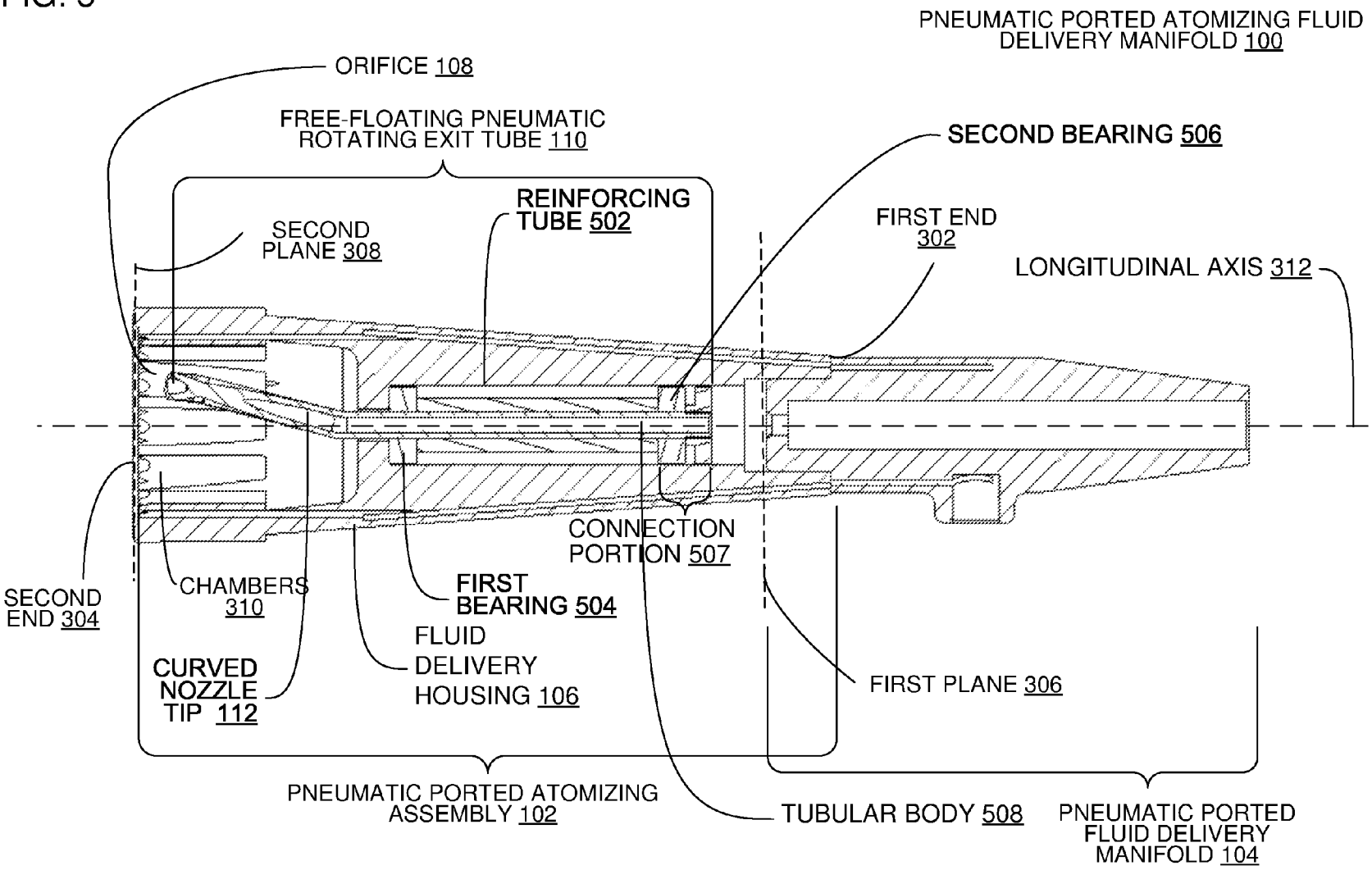
FIG. 5 is a cut-away side view of a pneumatic ported atomizing fluid delivery manifold, according to an implementation.

FIG. 5 is a cut-away side view of a pneumatic ported atomizing fluid delivery manifold 100, according to an implementation. Pneumatic ported atomizing fluid delivery manifold 100 includes pneumatic ported atomizing assembly 102 for rotary spray gun in accordance with an implementation includes a fluid delivery housing 106, a free-floating pneumatic rotating exit tube 110, a reinforcing tube 502, a first bearing 504 and a second bearing 506. The fluid delivery housing 106 is a hollow cylindrical member having one end thereof terminating in orifices(s) 108 and the other end thereof terminating in a connection portion 507. The free-floating pneumatic rotating exit tube 110 has an elongated tubular body portion 508 mounted in the fluid delivery housing 106 and a curved nozzle tip 112 obliquely extended from one end of the elongated tubular body portion 508 at an angle and suspending inside the fluid delivery housing 106 in proximity to the orifices(s) 108. The reinforcing tube 502 is mounted inside the fluid delivery housing 106 around the elongated tubular body portion 508 of the free-floating pneumatic rotating exit tube 110. The first bearing 504 is attached to one end of the reinforcing tube 502 and around one end of the elongated tubular body portion 508 of the free-floating pneumatic rotating exit tube 110 near the curved nozzle tip 112 and kept in contact with the inside wall of the fluid delivery housing 106. The second bearing 506 is attached to the other end of the reinforcing tube 502 around the other end of the elongated tubular body portion 508 of the free-floating pneumatic rotating exit tube 110 near the connection portion 507 and kept in contact with the inside wall of the fluid delivery housing 106. The pneumatic ported fluid delivery manifold 104 is mounted onto the connection portion 507 of the pneumatic ported atomizing assembly 102. The pneumatic ported fluid delivery manifold 104 includes a barrel 114.

When the free-floating pneumatic rotating exit tube 110 rotates in the first bearing 504 and in the second bearing 506, a volume of air or gas or fluid flowing across a surface area of the end of the curved nozzle tip 112 creates a negative area of air pressure outside the end of the curved nozzle tip 112. As the free-floating pneumatic rotating exit tube 110 rotates, the end of the curved nozzle tip 112 passes close by the orifices(s) 108. As fluid, such as cleaning fluid, exits the orifice(s) 108, the negative air pressure of the volume of air or gas or fluid flowing passing from the end of the curved nozzle tip 112 in parallel to the cleaning fluid exiting away from the orifice(s) 108 causes the cleaning fluid exiting away from the orifice(s) 108 to be atomized and causes the velocity of the cleaning fluid exiting away from the orifice(s) 108 to increase. In particular the atomized cleaning fluid exiting away from the orifice(s) 108 increases the effectiveness of the cleaning fluid because the atomized cleaning fluid is deposited as a thinner layer of cleaning fluid, and the atomized cleaning fluid is also deposited in a more uniform and consistent layer covering closer to 100% of the surface area of the object to be cleaned and because a thinner layer of cleaning fluid is deposited, less cleaning fluid is deposited, which results in a greater surface area of the object to be cleaned being covered with the cleaning fluid, with a smaller volume of cleaning fluid, which is more effective on providing cleaning.

The fluid delivery housing 106 has a frustum geometry. In some implementations, the frustum geometry of the fluid delivery housing 106 includes a conical geometry, as shown in FIGS. 1-7 and 29-33. In some implementations, the frustum geometry of the fluid delivery housing 106 includes a triangular geometry. In some implementations, the frustum geometry of the fluid delivery housing 106 includes a square geometry. In some implementations, the frustum geometry of the fluid delivery housing 106 includes a pentagonal geometry. In some implementations, the frustum geometry of the fluid delivery housing 106 includes a linear (straight) frustum geometry. In some implementations, the frustum geometry of the fluid delivery housing 106 includes a curved frustum geometry. In some implementations, the frustum geometry of the fluid delivery housing 106 includes a bent frustum geometry in which the plane of the first end is not parallel with the plane of the second end.

The free-floating pneumatic rotating exit tube 110 (also known as a 'free bearing atomizer') is positioned along a longitudinal center axis 510 of the fluid delivery housing 106. The free-floating pneumatic rotating exit tube 110 has no inner fluid tube within the free-floating pneumatic rotating exit tube 110. The free-floating pneumatic rotating exit tube 110 has only gas passing through the free-floating pneumatic rotating exit tube 110, no liquid passes through the free-floating pneumatic rotating exit tube 110. In conventional apparatus, the inner fluid tube (not shown in FIG. 1-40) is a very narrow tube that is made from a nylon material inside a rotating member, which creates wear on the inner fluid tube when the rotating member rotates, which eventually causes the inner fluid tube to physically disintegrate and fail, which in turn requires the inner fluid tube to be replaced at a regular time intervals. The replacement cost of the inner fluid tube in conventional apparatus is expensive compared to the overall cost of the conventional pneumatic rotational cleaning tool. In addition, the inner fluid tube of conventional apparatus is so small and thin that the inner fluid tube frequently separates from the mounting point from the connecting jar during operation, which sometimes pushes the inner fluid tube over, laying the inner fluid tube over flat and causing a kink in the inner fluid tube, which stop the flow of fluid through the inner fluid tube over. However, the free-floating pneumatic rotating exit tube 110 of the pneumatic ported atomizing fluid delivery manifold 100 in FIG. 1-7 overcomes the cost of the wear on the inner fluid tube by eliminating the use of the inner fluid tube or any other tubes or parts that come into direct contact with any rotating parts. In addition, the narrow dimensions of the inner fluid tube conventional apparatus causes the inner fluid tube to become blocked frequently during operation. Yet the width of the inner fluid tube can't be increased to reduce the frequency of blockage because a wider inner fluid tube cannot create enough negative pressure at the exit point of the inner fluid tube to lift the extra weight of the fluid inside the inner fluid tube from the storage jar to the exit point of the inner fluid tube. Thus the pneumatic ported atomizing fluid delivery manifold 100 in FIG. 1-7 has no fluid transfer tube that requires periodic replacement, or any other parts that require periodic replacement. The absence of the fluid transfer tube reduces 'downtime' opportunity cost of the use of the apparatus and eliminates the direct cost and labor of replacing worn-out parts such as the inner fluid tube. Therefore, the free-floating pneumatic rotating exit tube 110 and the absence of the inner fluid tube greatly in the pneumatic ported atomizing fluid delivery manifold 100 of FIG. 1-7 improves the cost effectiveness of the pneumatic ported atomizing fluid delivery manifold 100 of FIG. 1-7

As discussed in FIG. 3, liquid exits only through the multiple holes at the open end of the pneumatic ported atomizing assembly 102 when a lower than atmosphere pressure is reached at the exit point of the hole. The exit holes 324 are set in a circular solid part of the fluid delivery housing 106 and each exit hole 324 has its own circler solid part of the fluid delivery housing 106. The surface of the solid circler part facing the center of the fluid delivery housing 106 has a flat surface on it that is at an angle of 25% from the centerline of the fluid delivery housing 106 but not confined to this angle. Each exit hole 324 has a diameter of 0.4 mm, but not fixed at this size as depending on the size of the outer tube and the fluid needed they can vary from 0.2 up to 1.00. The exit of the exit hole 324 is placed 0.5 mm from the edge of the top surface of the flat service from the inside line of the outer tube. The exit holes 324 are connected to a fluid chamber within the wall of the round tube.

Figure 6:
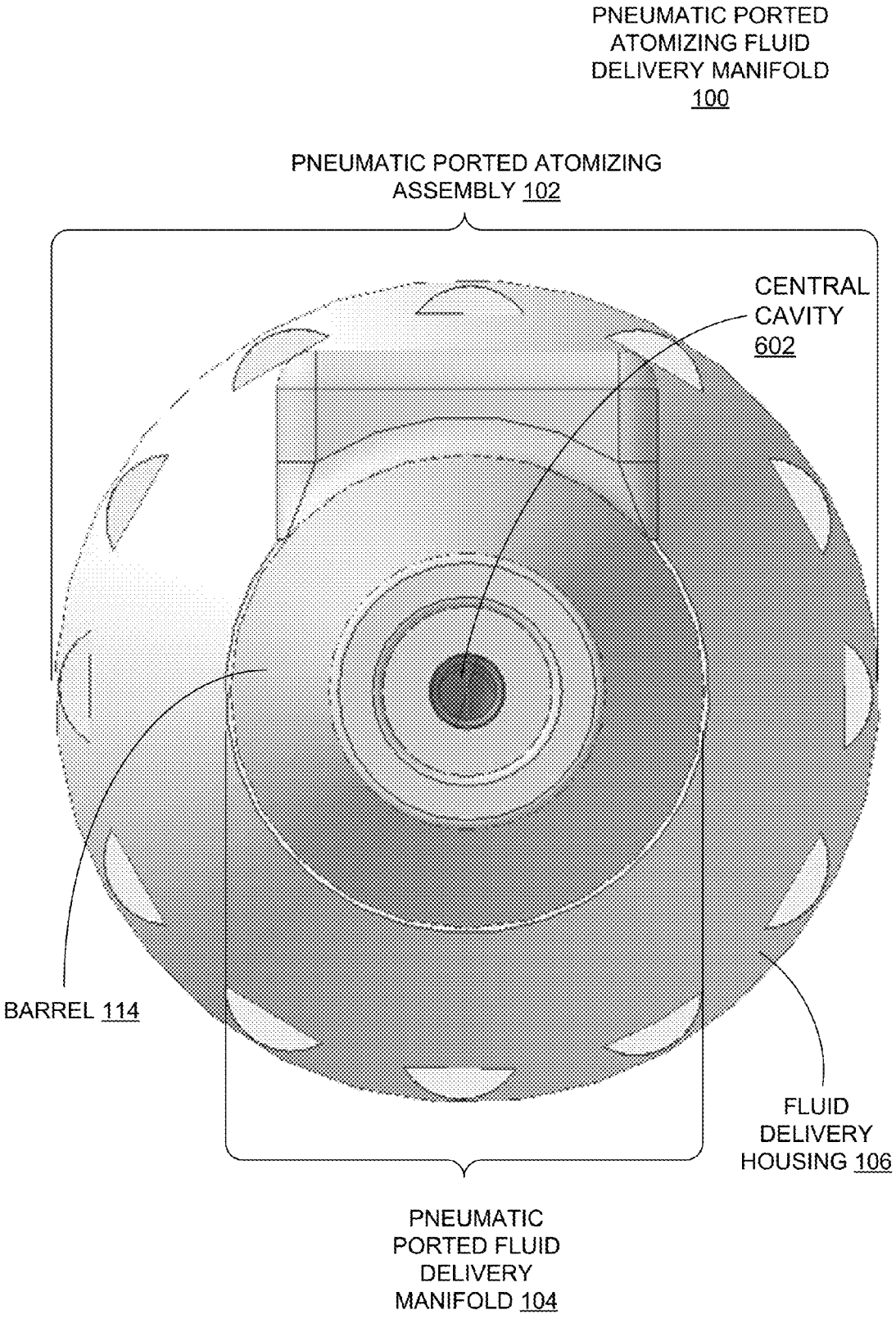
FIG. 6 is a rear view of an isometric diagram of a pneumatic ported atomizing fluid delivery manifold, according to an implementation.

FIG. 6 is a rear view of an isometric diagram of a pneumatic ported atomizing fluid delivery manifold 100, according to an implementation. Pneumatic ported atomizing fluid delivery manifold 100 includes the pneumatic ported atomizing assembly 102 for rotary spray gun in accordance with an implementation is shown that includes a fluid delivery housing 106. The pneumatic ported fluid delivery manifold 104 is attached on onto the pneumatic ported atomizing assembly 102. The pneumatic ported fluid delivery manifold 104 includes a barrel 114. The pneumatic ported atomizing assembly 102 includes a central cavity 602 that operably coupled to the free-floating pneumatic rotating exit tube 110.

Figure 7:
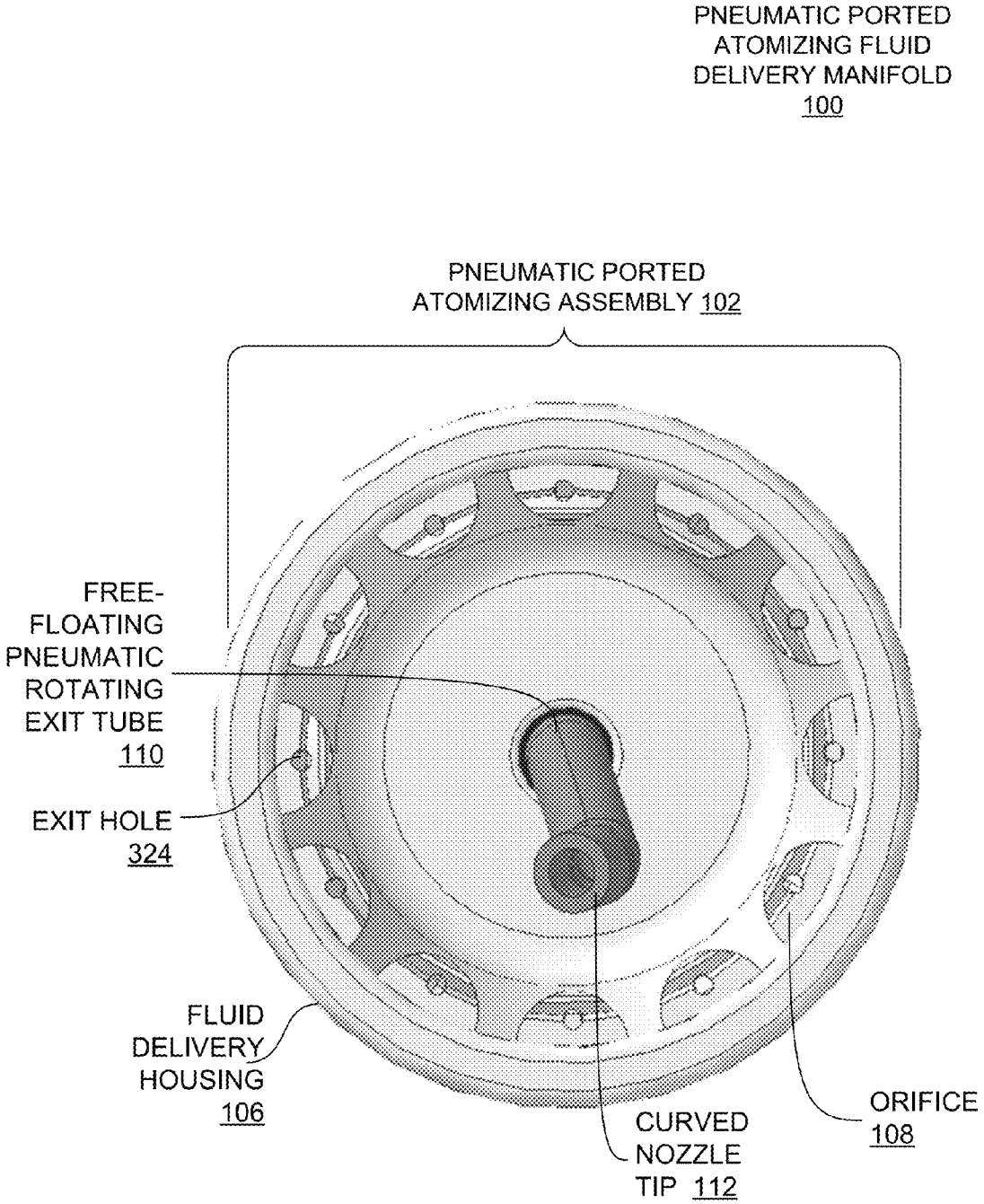
FIG. 7 is a front view of an isometric diagram of a pneumatic ported atomizing fluid delivery manifold, according to an implementation.

FIG. 7 is a front view of an isometric diagram of a pneumatic ported atomizing fluid delivery manifold 100, according to an implementation. Pneumatic ported atomizing fluid delivery manifold 100 includes pneumatic ported atomizing assembly 102 for rotary spray gun in accordance with an implementation is shown that includes a fluid delivery housing 106 and a free-floating pneumatic rotating exit tube 110. The fluid delivery housing 106 is a hollow cylindrical member having one end thereof terminating in orifices(s) 108. The free-floating pneumatic rotating exit tube 110 is mounted in the fluid delivery housing 106 and includes a curved nozzle tip 112 obliquely extended at an angle inside the fluid delivery housing 106 in proximity to the orifices(s) 108.

Figure 8:
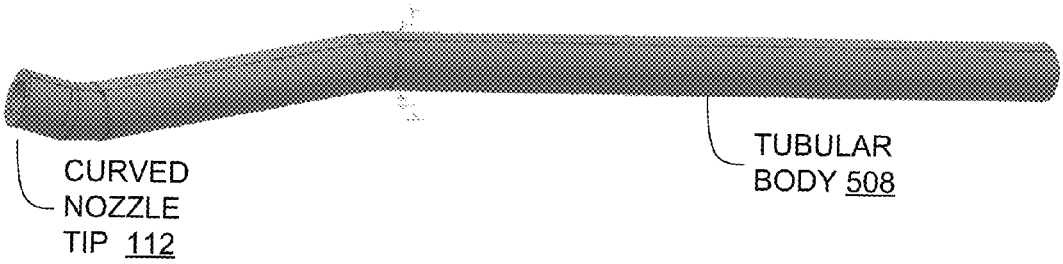
FIG. 8 is an isometric diagram of a free-floating pneumatic rotating exit tube, according to an implementation.

FIG. 8 is an isometric diagram of the free-floating pneumatic rotating exit tube 110, according to an implementation. The free-floating pneumatic rotating exit tube 110 consists of a free-floating pneumatic rotating exit tube 110 which is further comprised of elongated tubular body portion 508 and a curved nozzle tip 112 which is obliquely extended at an angle. Inside the fluid delivery housing 106 is a free-floating pneumatic rotating exit tube 110 made off any material with an entrance 802 and an exit 804 for the flow of a gas. The exit 804 of the free-floating pneumatic rotating exit tube 110 is placed at a distance off 2 mm at the 180 degree mark and a distance of 3 mm at the 90 Degree mark of the fluid delivery housing 106 but is not defined to these distances. The gas as it exits the free-floating pneumatic rotating exit tube 110 past the exit hole 324 creates a slightly lower that atmosphere pressure (atmosphere pressure being 14.78 psi) of anywhere between +5 to 8 psi which lowers the pressure inside the fluid bowl-chamber 320 thus having atmosphere pressure inside the fluid bowl-chamber 320 of the orifices(s) 108 being greater than the fluid exit chamber which forces the fluid out through the exit holes 324 via the fluid chambers.

Figure 9:
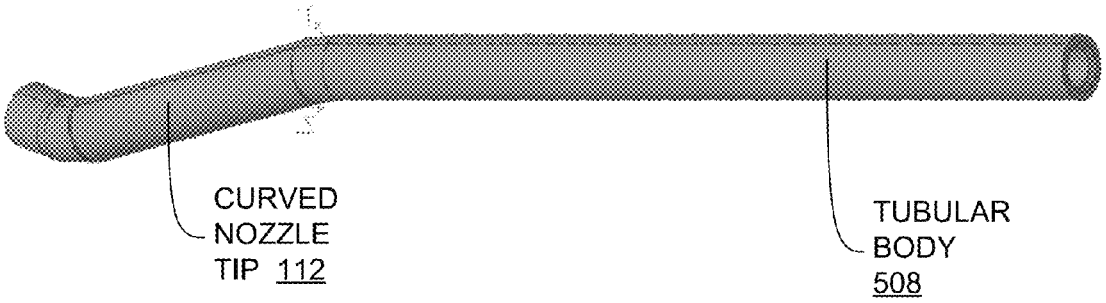
FIG. 9 is an isometric diagram of the free-floating pneumatic rotating exit tube, according to an implementation.

FIG. 9 is an isometric diagram of the free-floating pneumatic rotating exit tube 110, according to an implementation. The free-floating pneumatic rotating exit tube 110 consists of an elongated tubular body portion 508 and a curved nozzle tip 112 which is obliquely extended at an angle.

Figure 10:
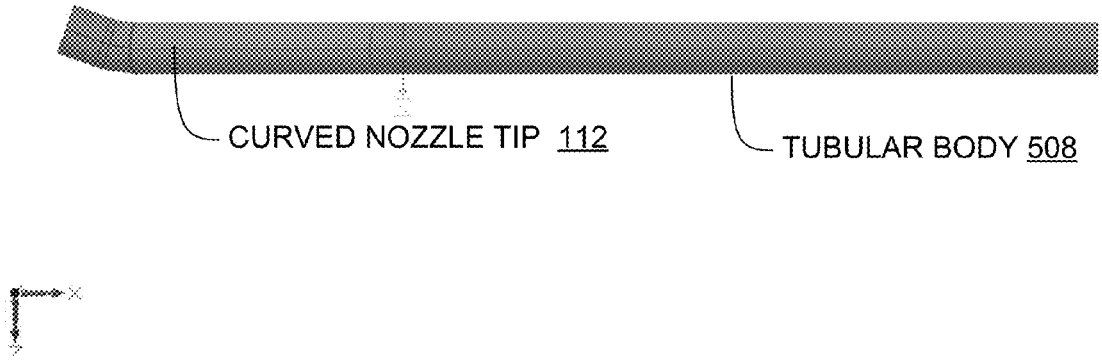
FIG. 10 is a top view of an isometric diagram of the free-floating pneumatic rotating exit tube, according to an implementation.

FIG. 10 is a top view of an isometric diagram of the free-floating pneumatic rotating exit tube 110, according to an implementation. The free-floating pneumatic rotating exit tube 110 consists of an elongated tubular body portion 508 and a curved nozzle tip 112 which is obliquely extended at an angle.

Figure 11:
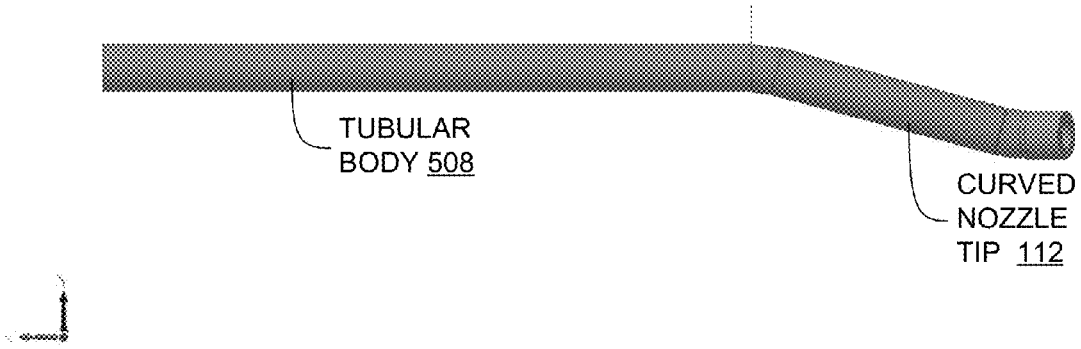
FIG. 11 is a side view of an isometric diagram of the free-floating pneumatic rotating exit tube, according to an implementation.

FIG. 11 is a side view of an isometric diagram of the free-floating pneumatic rotating exit tube 110, according to an implementation. The free-floating pneumatic rotating exit tube 110 consists of an elongated tubular body portion 508 and a curved nozzle tip 112 which is obliquely extended at an angle.

Figure 12:
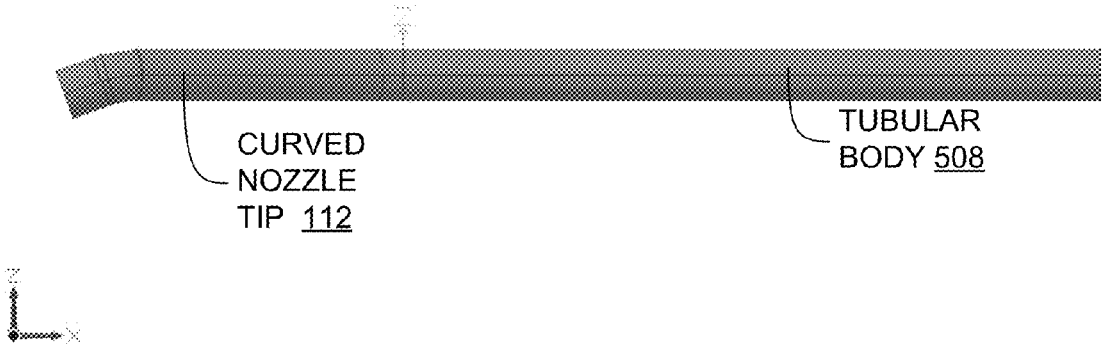
FIG. 12 is a bottom view of an isometric diagram of the free-floating pneumatic rotating exit tube, according to an implementation.

FIG. 12 is a bottom view of an isometric diagram of the free-floating pneumatic rotating exit tube 110, according to an implementation. The free-floating pneumatic rotating exit tube 110 consists of an elongated tubular body portion 508 and a curved nozzle tip 112 which is obliquely extended at an angle.

Figure 13:
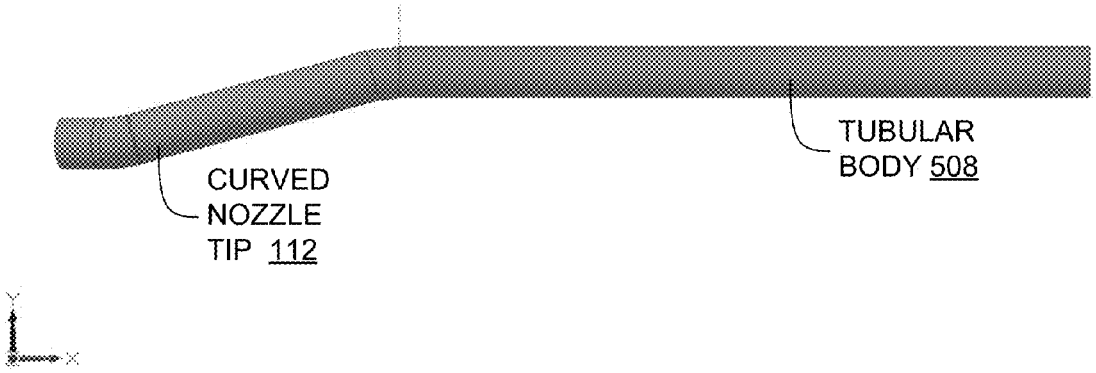
FIG. 13 is a side view of an isometric diagram of the free-floating pneumatic rotating exit tube, according to an implementation.

FIG. 13 is a side view of an isometric diagram of the free-floating pneumatic rotating exit tube 110, according to an implementation. The free-floating pneumatic rotating exit tube 110 consists of an elongated tubular body portion 508 and a curved nozzle tip 112 which is obliquely extended at an angle.

Figure 14:
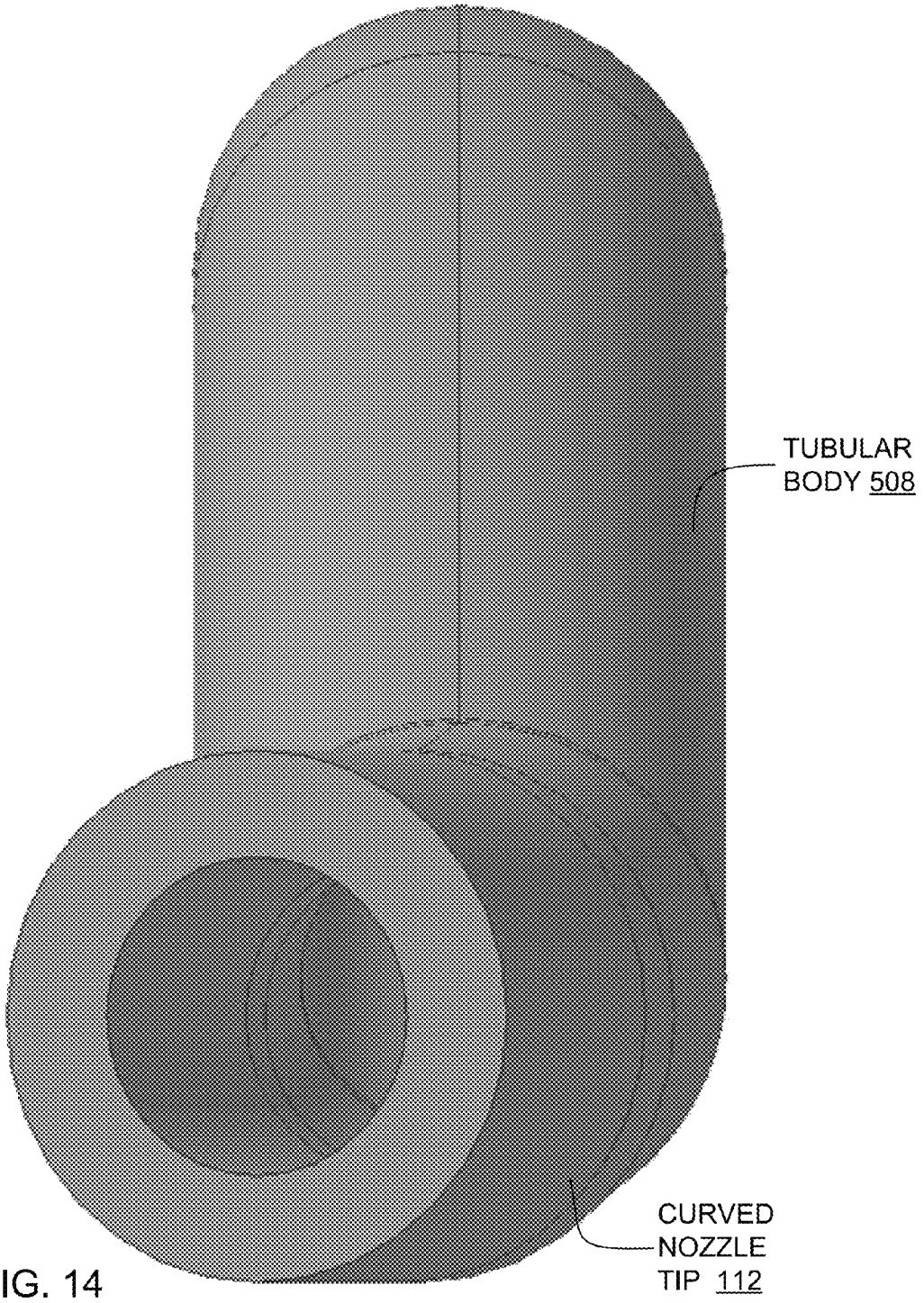
FIG. 14 is a front view of an isometric diagram of the free-floating pneumatic rotating exit tube, according to an implementation.

FIG. 14 is a front view of an isometric diagram of the free-floating pneumatic rotating exit tube 110, according to an implementation. The free-floating pneumatic rotating exit tube 110 consists of an elongated tubular body portion 508 and a curved nozzle tip 112 which is obliquely extended at an angle. Please note that the curved nozzle tip 112 includes no inner fluid tube inside the curved nozzle tip 112.

Figure 15:
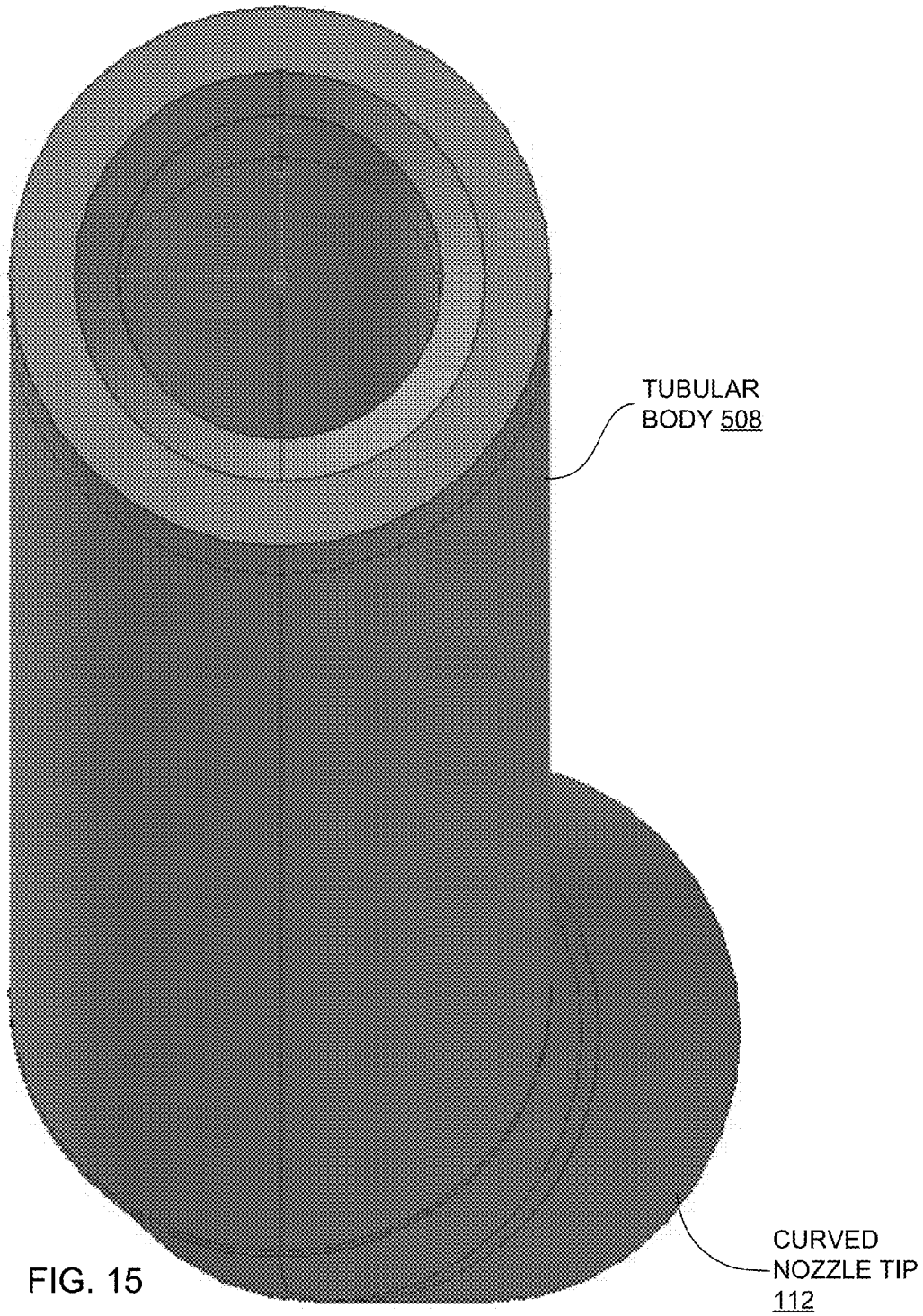
FIG. 15 is a bottom view of an isometric diagram of the free-floating pneumatic rotating exit tube, according to an implementation.

FIG. 15 is a bottom view of an isometric diagram of the free-floating pneumatic rotating exit tube 110, according to an implementation. The free-floating pneumatic rotating exit tube 110 consists of an elongated tubular body portion 508 and a curved nozzle tip 112 which is obliquely extended at an angle. Please note that the elongated tubular body portion 508 includes no inner fluid tube in the elongated tubular body portion 508.

Figure 16:
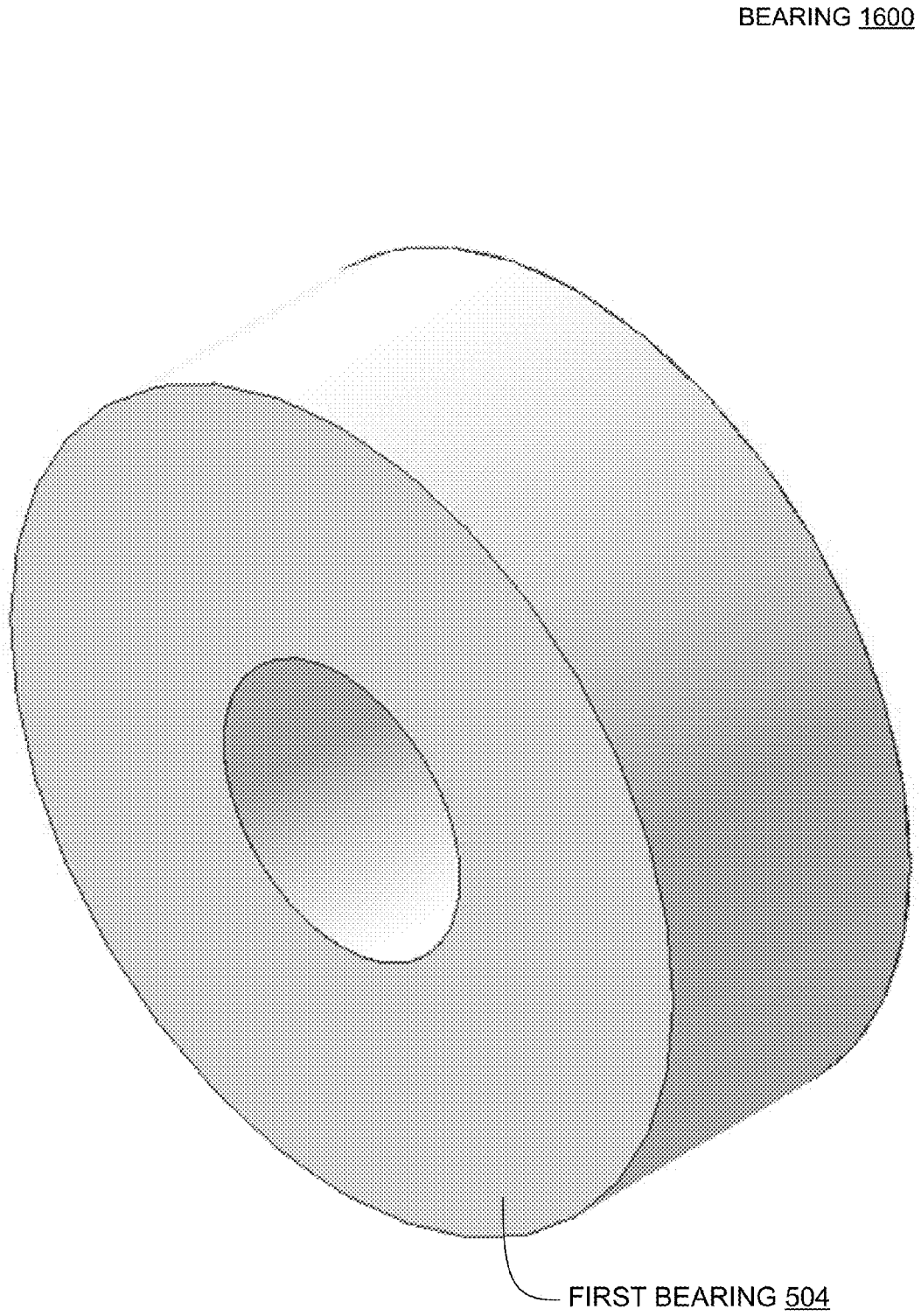
FIG. 16 is an isometric diagram of a 4 mm bearing, according to an implementation.

FIG. 16 is an isometric diagram of a 4 mm bearing 1600, according to an implementation.

Figure 17:
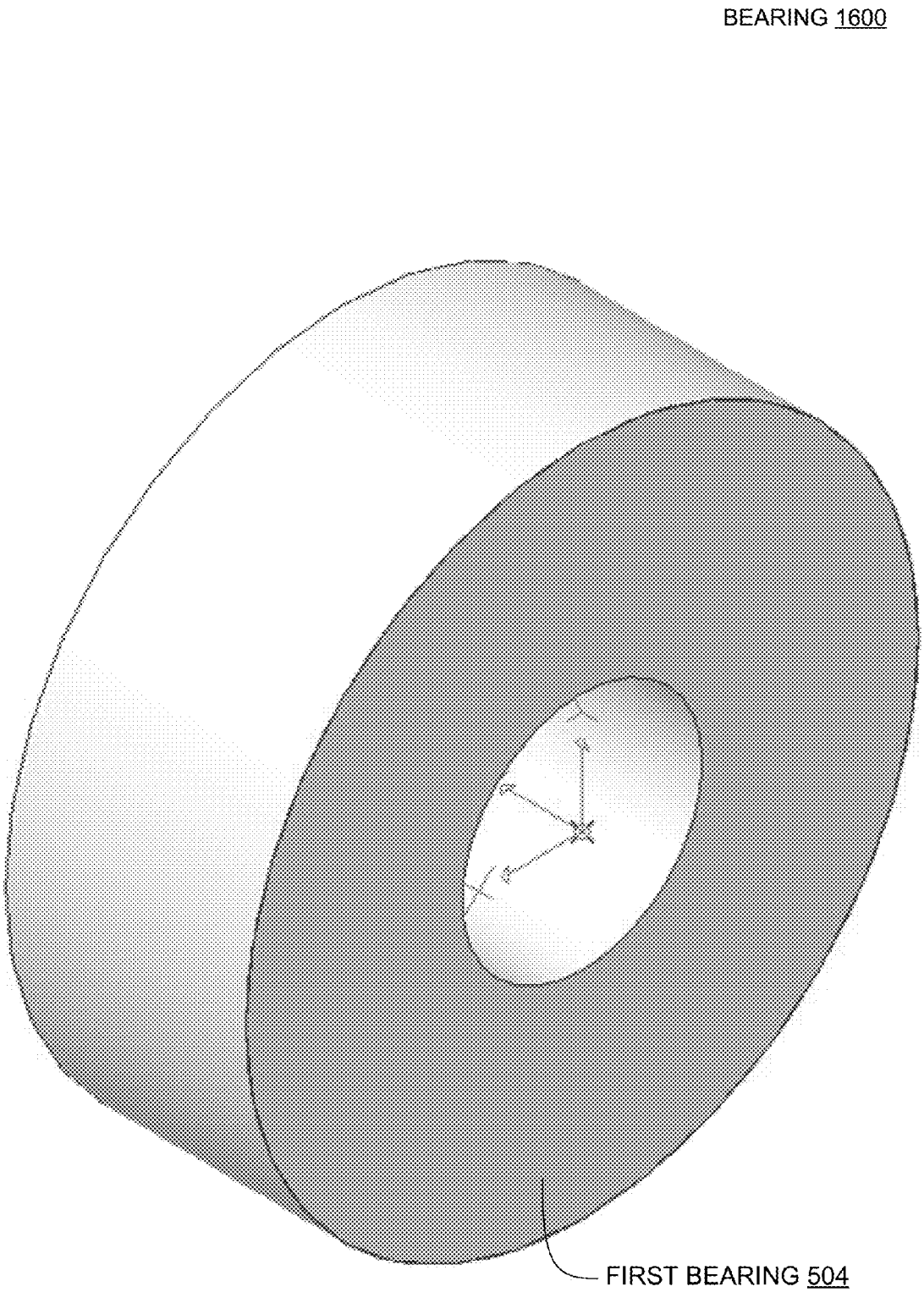
FIG. 17 is an isometric diagram of a 4 mm bearing, according to an implementation.

FIG. 17 is an isometric diagram of a 4 mm bearing 1600, according to an implementation.

Figure 18:
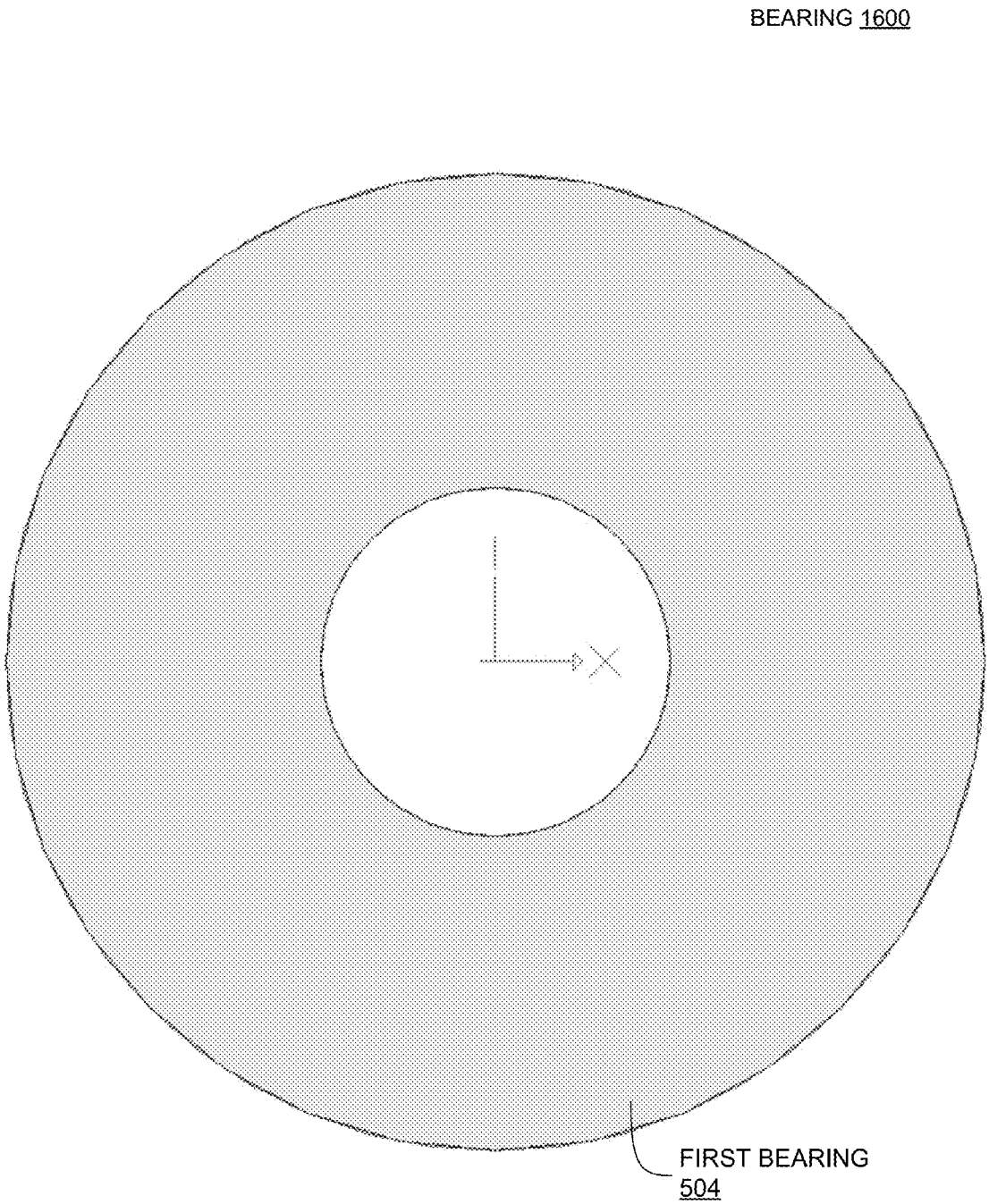
FIG. 18 is a front view of an isometric diagram of a 4 mm bearing, according to an implementation.

FIG. 18 is a front view of an isometric diagram of a 4 mm bearing 1600, according to an implementation.

Figure 19:
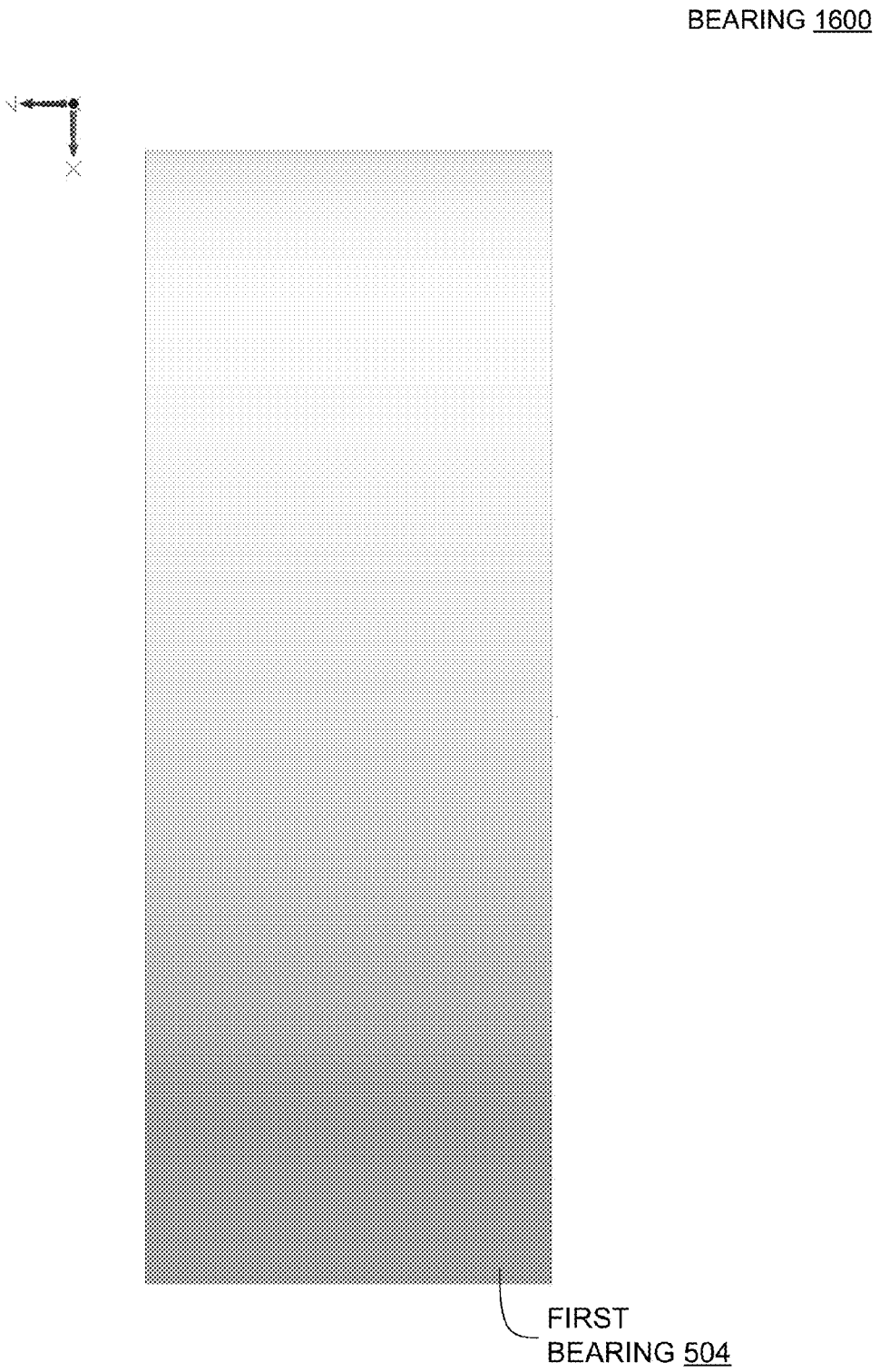
FIG. 19 is a side view of an isometric diagram of a 4 mm bearing, according to an implementation.

FIG. 19 is a side view of an isometric diagram of a 4 mm bearing 1600, according to an implementation.

Figure 20:
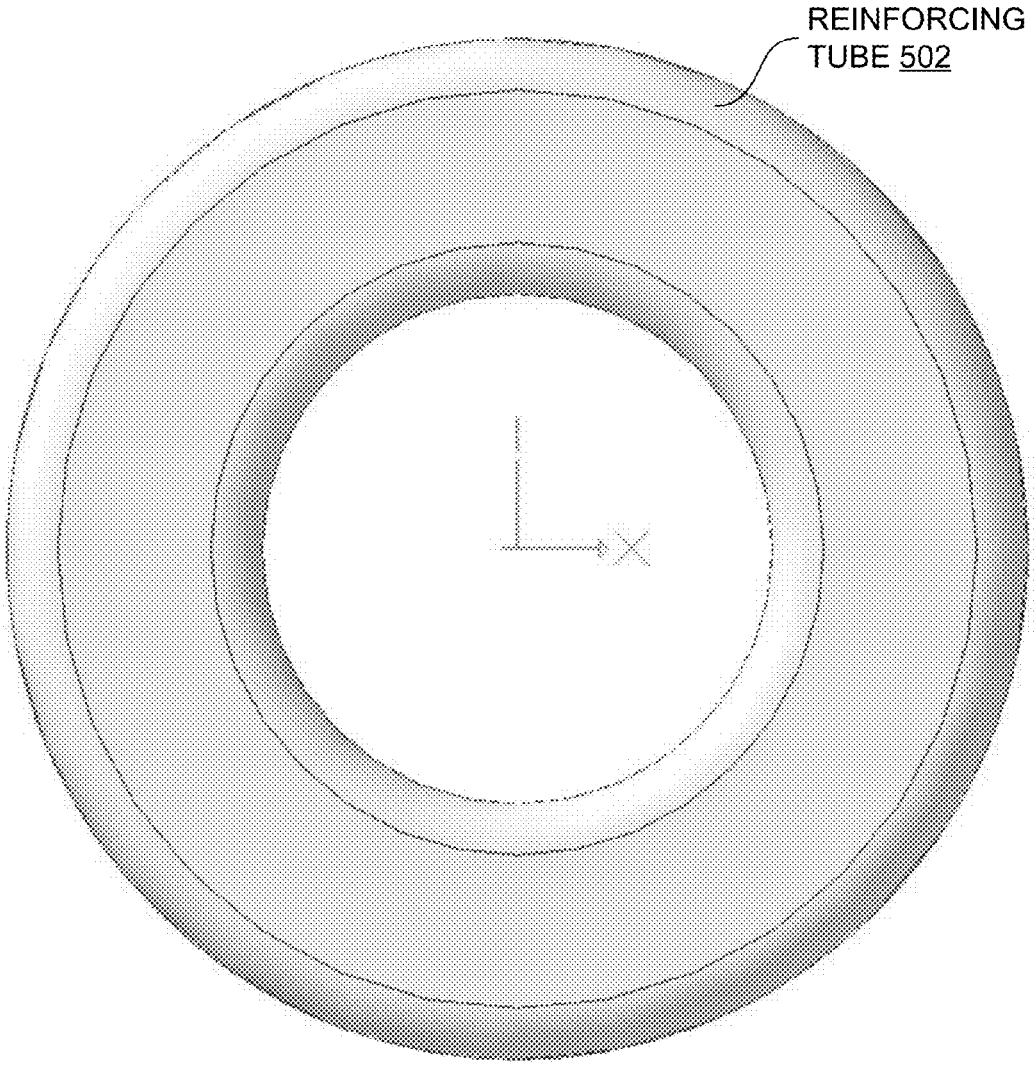
FIG. 20 is a front view of an isometric diagram of a bearing spacer, according to an implementation.

FIG. 20 is a front view of an isometric diagram of a bearing spacer 2000, according to an implementation.

Figure 21:
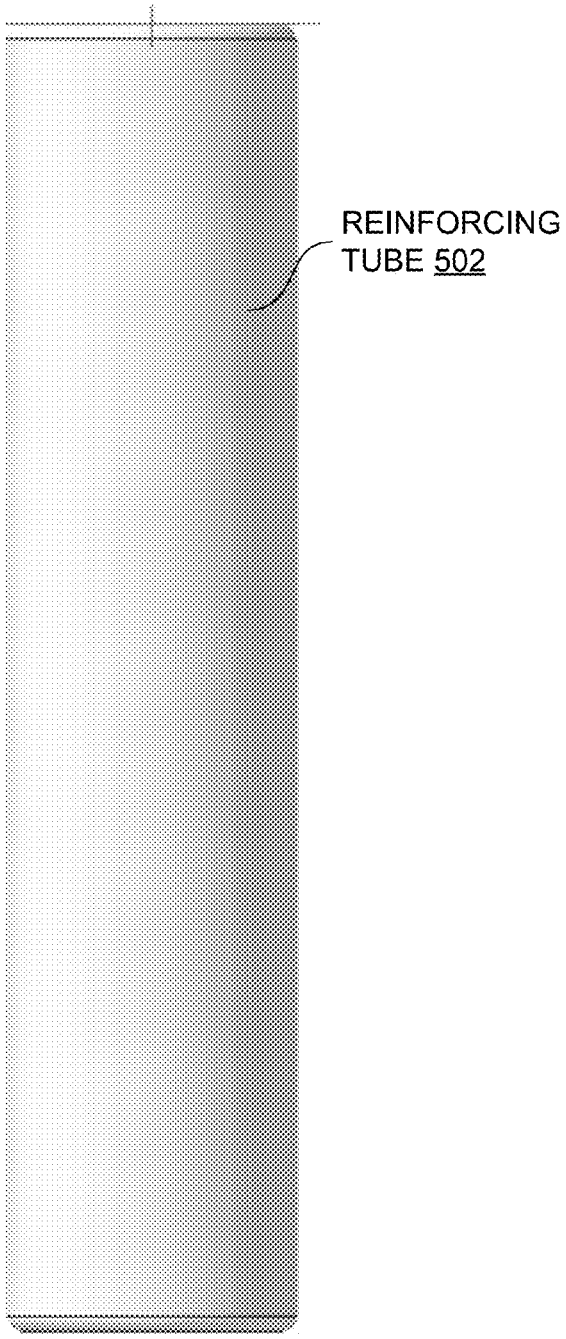
FIG. 21 is a top view of an isometric diagram of a bearing spacer, according to an implementation.

FIG. 21 is a top view of an isometric diagram of a bearing spacer 2000, according to an implementation.

Figure 22:
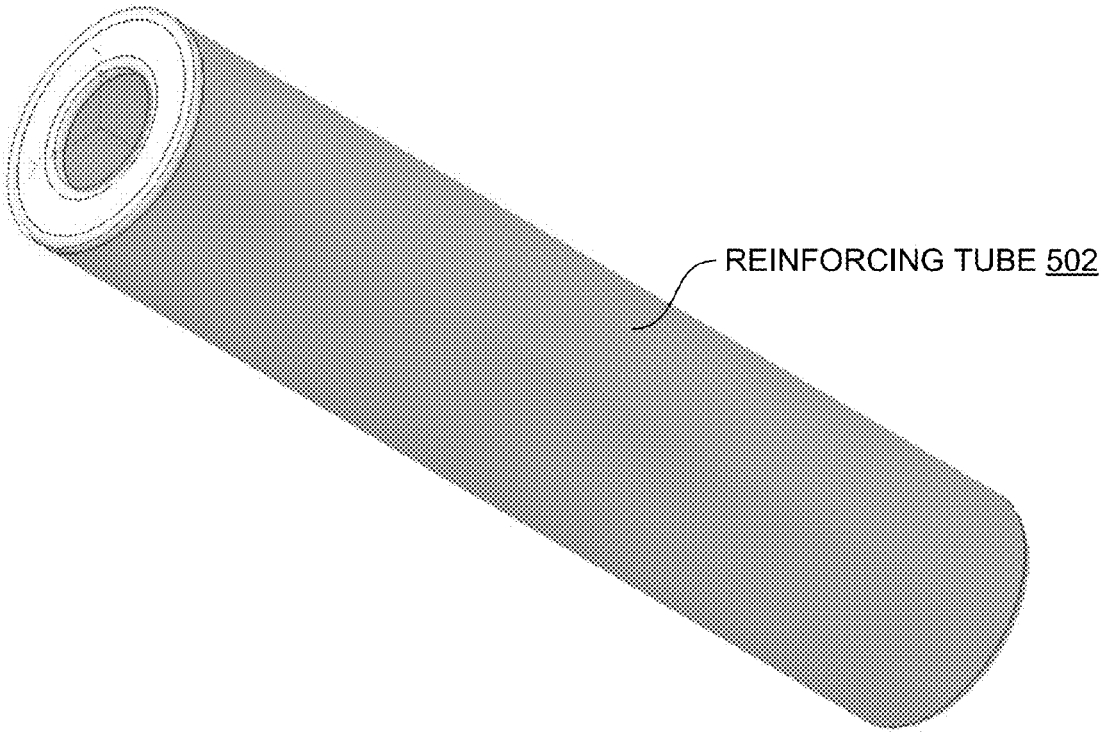
FIG. 22 is an isometric diagram of a bearing spacer, according to an implementation.

FIG. 22 is an isometric diagram of a bearing spacer 2000, according to an implementation.

Figure 23:
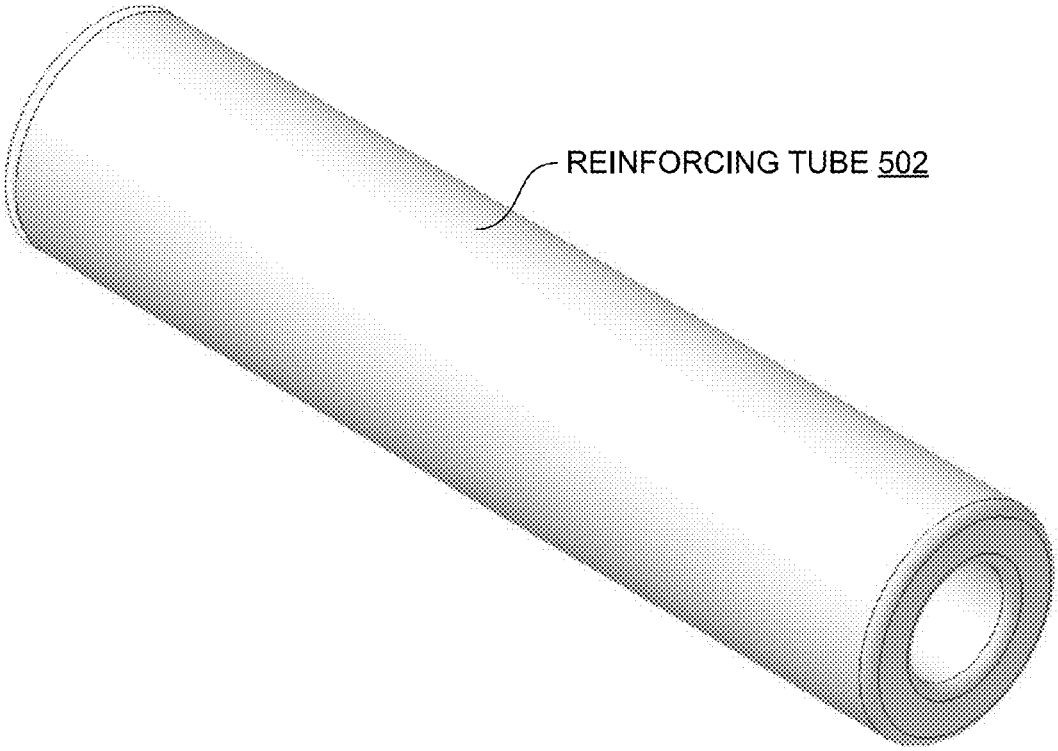
FIG. 23 is an isometric diagram of a bearing spacer, according to an implementation.

FIG. 23 is an isometric diagram of a bearing spacer 2000, according to an implementation.

Figure 24:
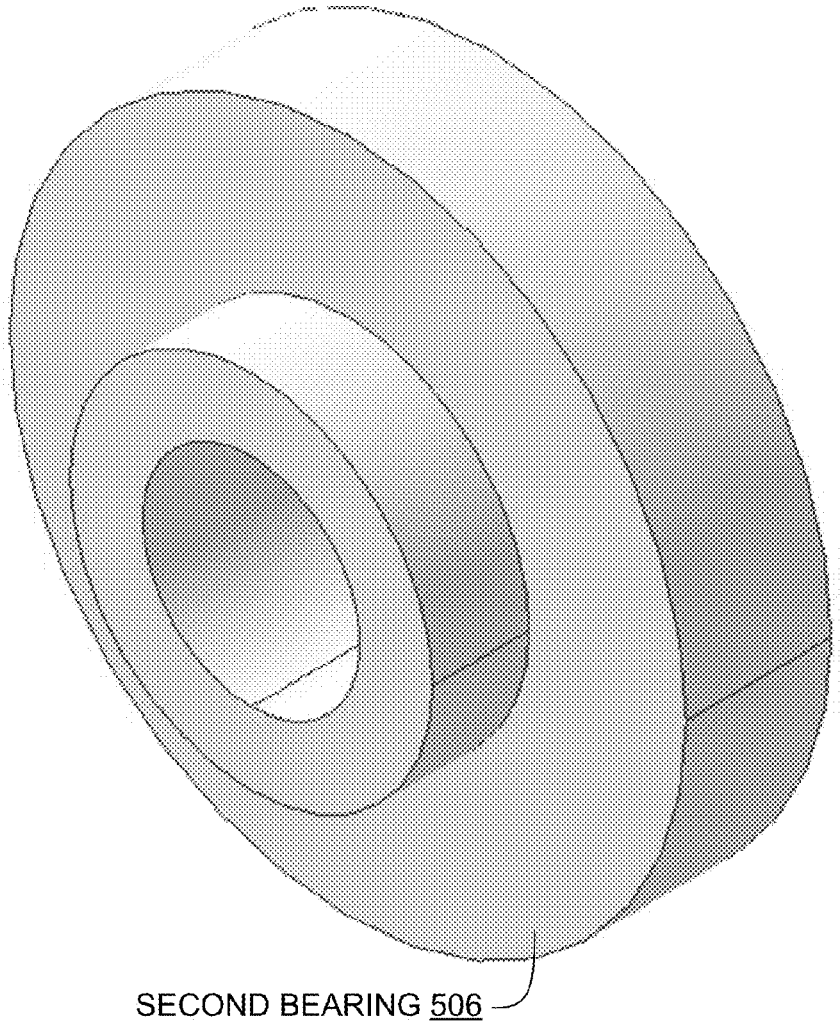
FIG. 24 is an isometric diagram of an inner tube nut, according to an implementation.

FIG. 24 is an isometric diagram of an inner tube nut 2400, according to an implementation.

Figure 25:
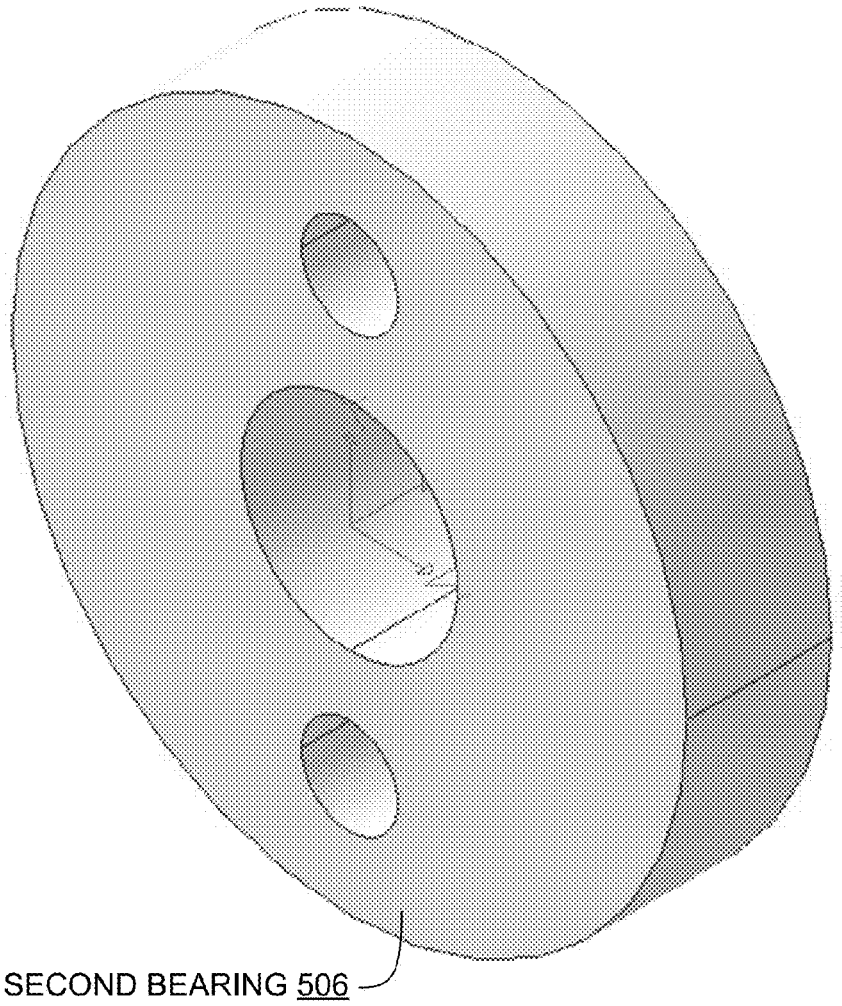
FIG. 25 is an isometric diagram of an inner tube nut, according to an implementation.

FIG. 25 is an isometric diagram of an inner tube nut 2400, according to an implementation.

Figure 26:
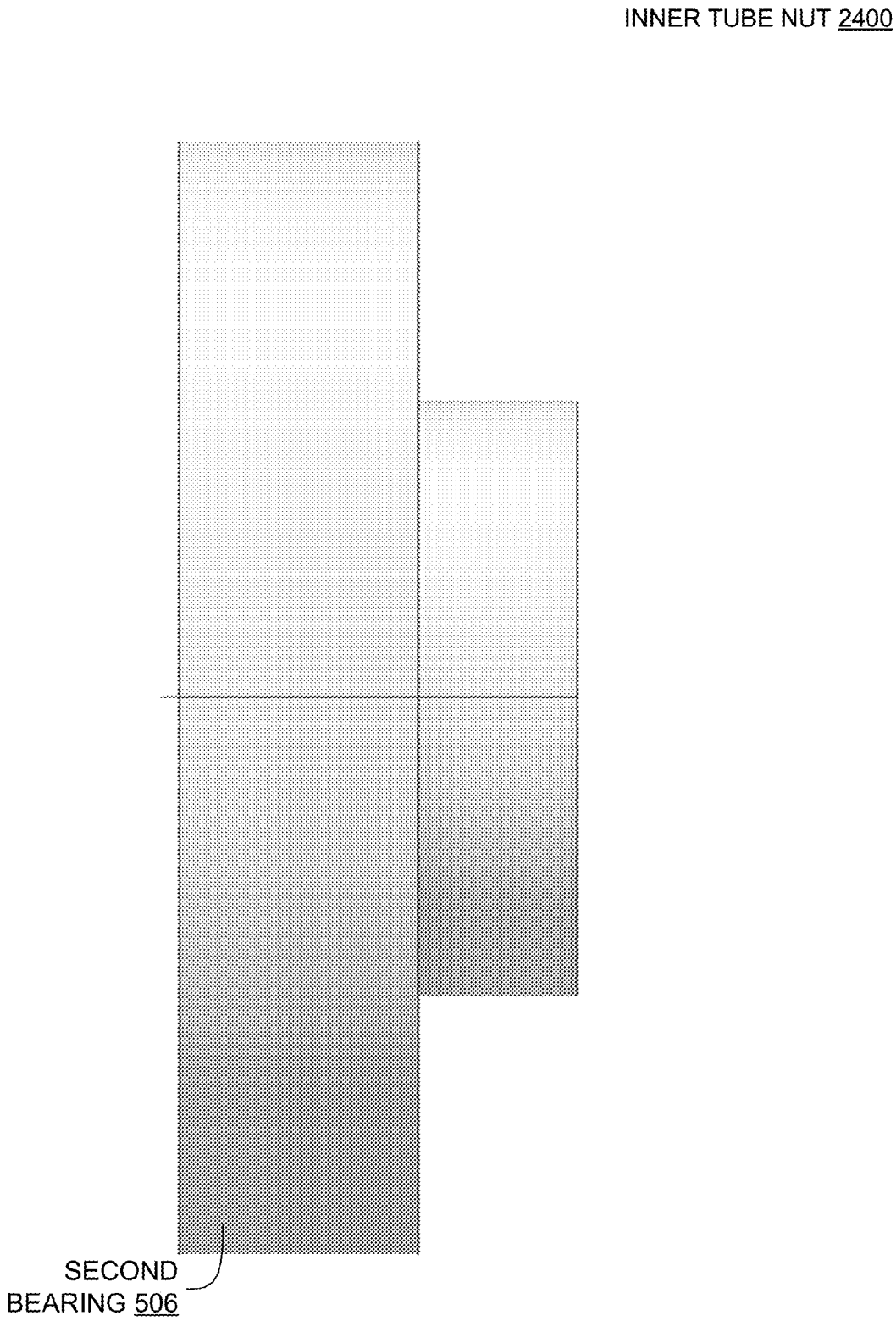
FIG. 26 is a side view of an isometric diagram of an inner tube nut, according to an implementation.

FIG. 26 is a side view of an isometric diagram of an inner tube nut 2400, according to an implementation.

Figure 27:
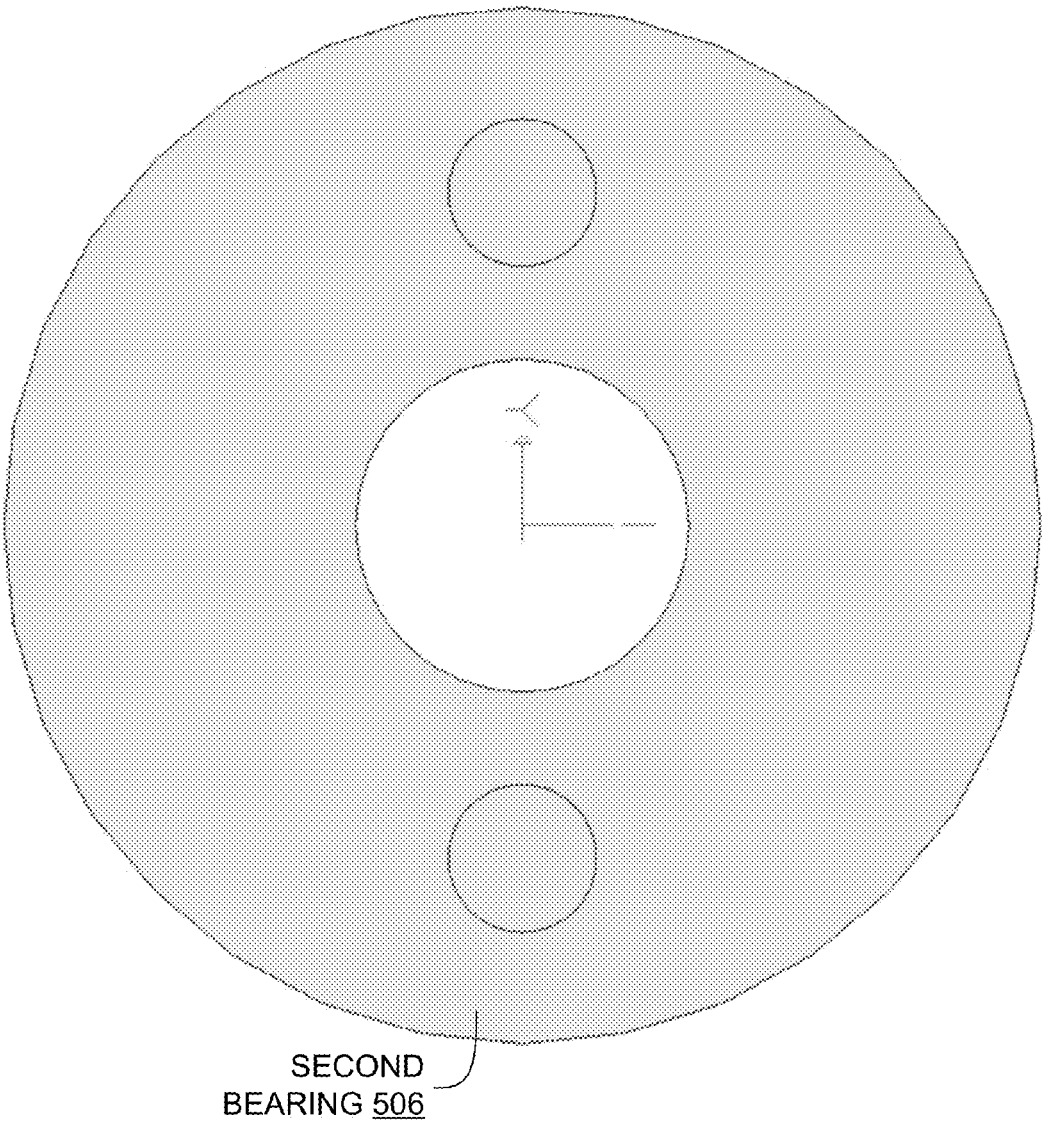
FIG. 27 is a rear view of an isometric diagram of an inner tube nut, according to an implementation.

FIG. 27 is a rear view of an isometric diagram of an inner tube nut 2400, according to an implementation.

Figure 28:
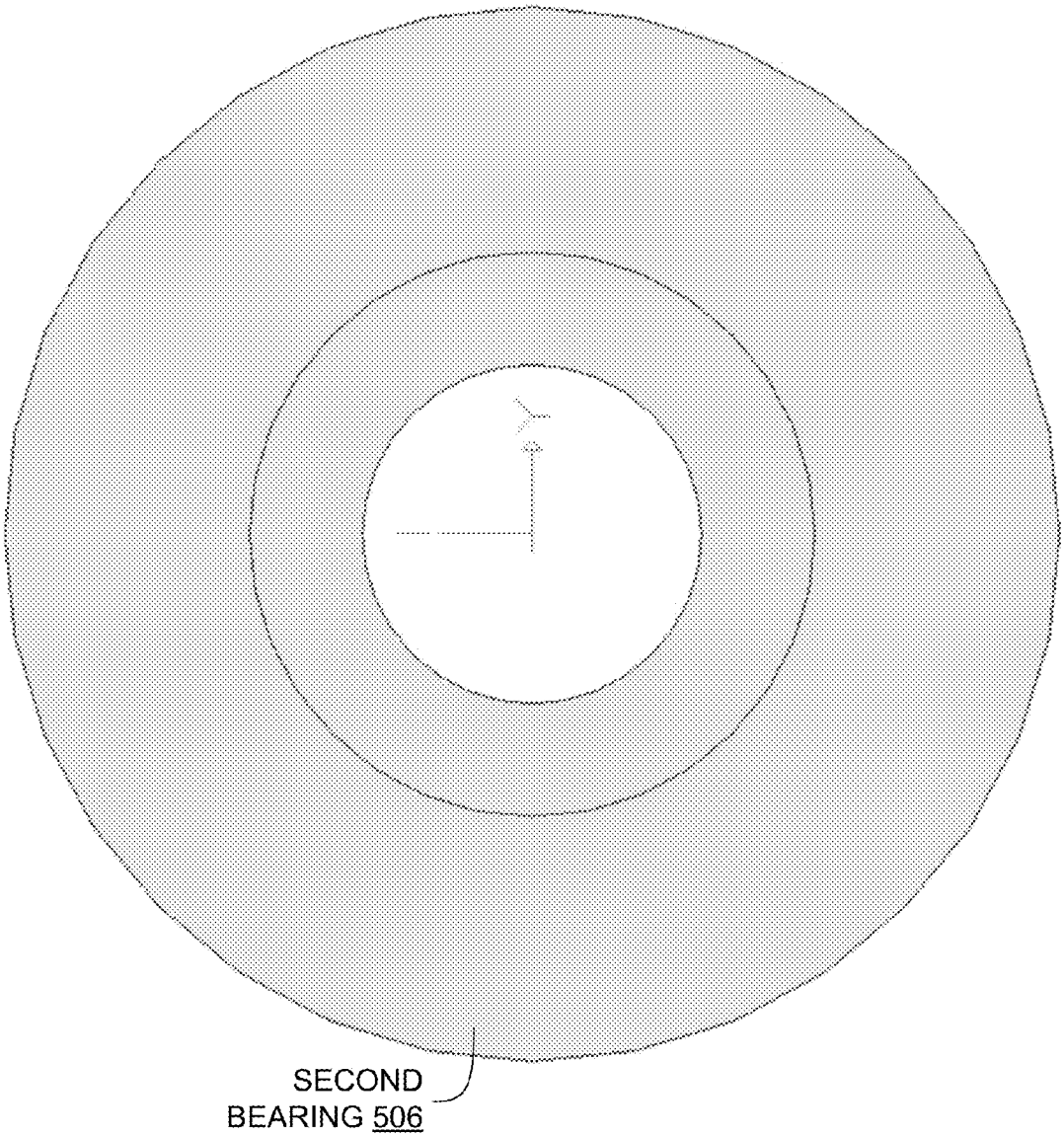
FIG. 28 is a front view of an isometric diagram of an inner tube nut, according to an implementation.

FIG. 28 is a front view of an isometric diagram of an inner tube nut 2400, according to an implementation.

Figure 29:
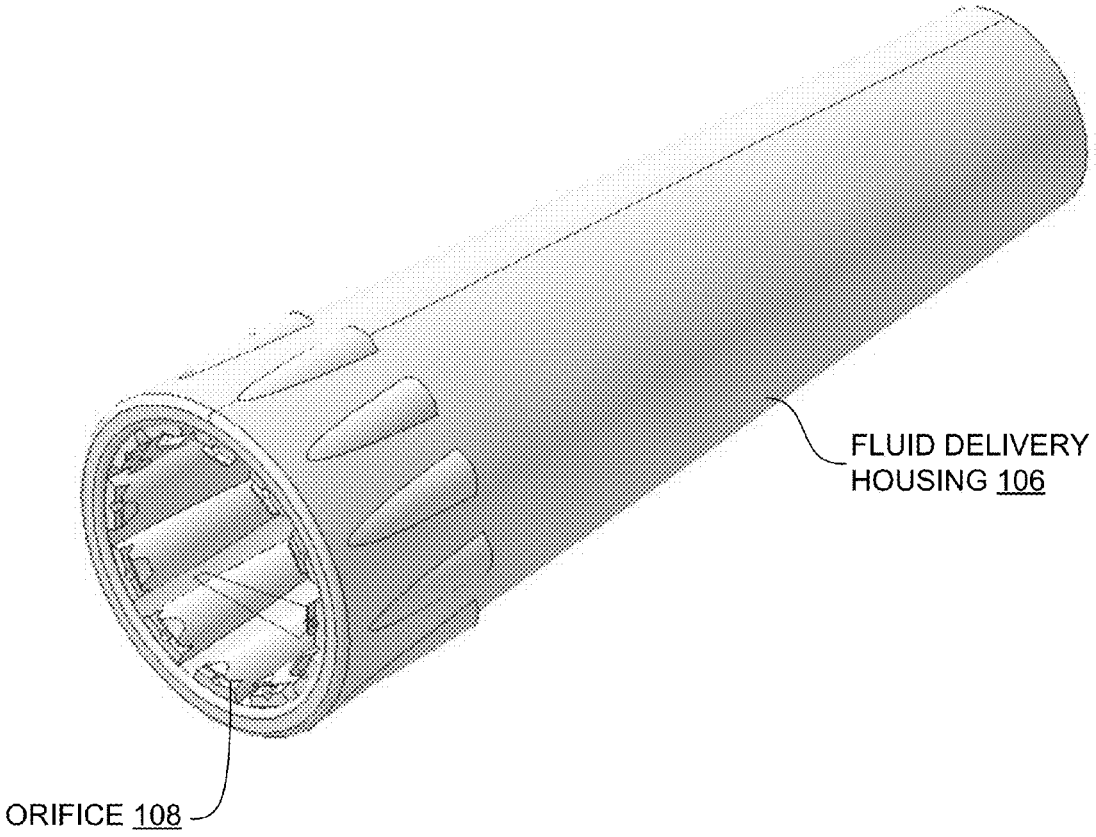
FIG. 29 is an isometric diagram of a pneumatic ported atomizing assembly, according to an implementation.

FIG. 29 is an isometric diagram of a pneumatic ported atomizing assembly 102, according to an implementation. The pneumatic ported atomizing assembly 102 consists of a fluid delivery housing 106. The fluid delivery housing 106 opens on one end with orifices(s) 108. Each of the orifices(s) 108 has an angled surface which creates a higher velocity in the gas as the gas from the curved nozzle tip 112 of the free-floating pneumatic rotating exit tube 110 passes by the angled surface of the orifices(s) 108 and the exit hole 324.

Figure 30:
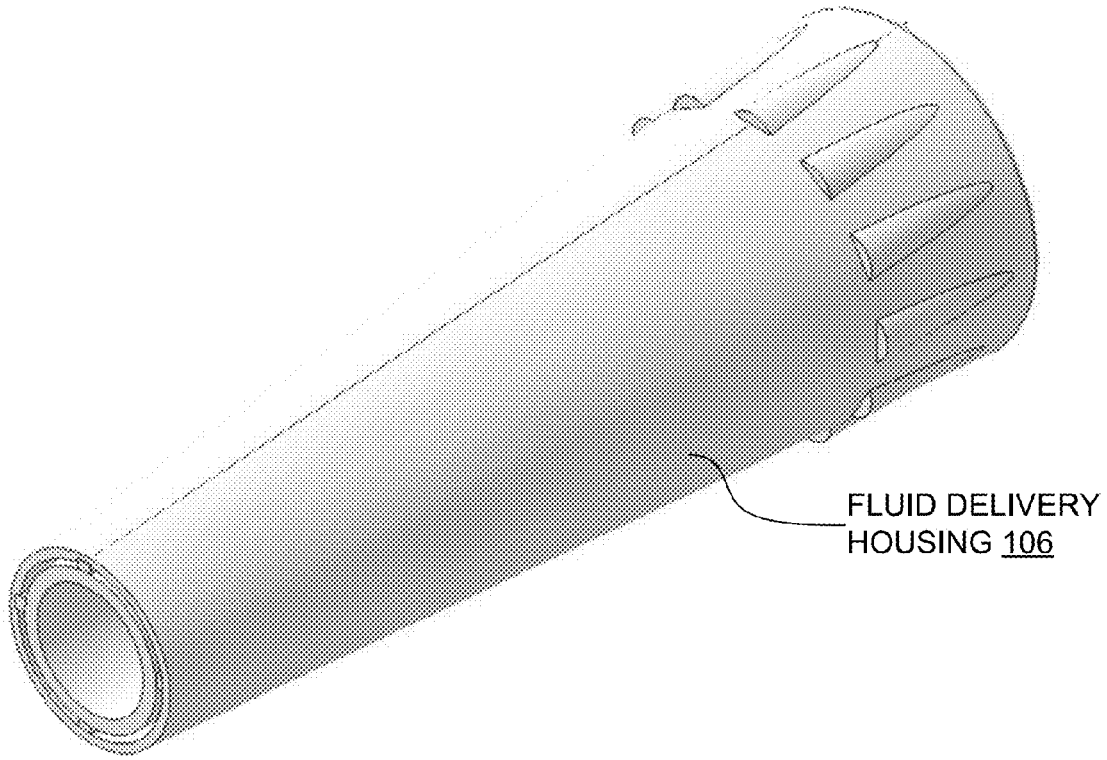
FIG. 30 is an isometric diagram of a pneumatic ported atomizing assembly, according to an implementation.

FIG. 30 is an isometric diagram of a pneumatic ported atomizing assembly 102, according to an implementation. The pneumatic ported atomizing assembly 102 consists of a fluid delivery housing 106.

Figure 31:
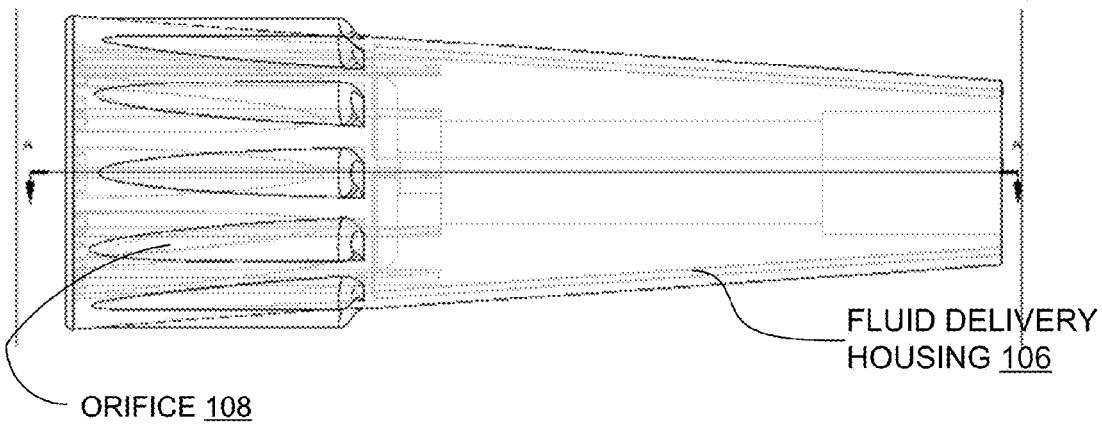
FIG. 31 is a side view of an isometric diagram of a pneumatic ported atomizing assembly, according to an implementation.

FIG. 31 is a side view of an isometric diagram of a pneumatic ported atomizing assembly 102, according to an implementation. The pneumatic ported atomizing assembly 102 consists of a fluid delivery housing 106. The fluid delivery housing 106 opens on one end with orifices(s) 108.

Figure 32:
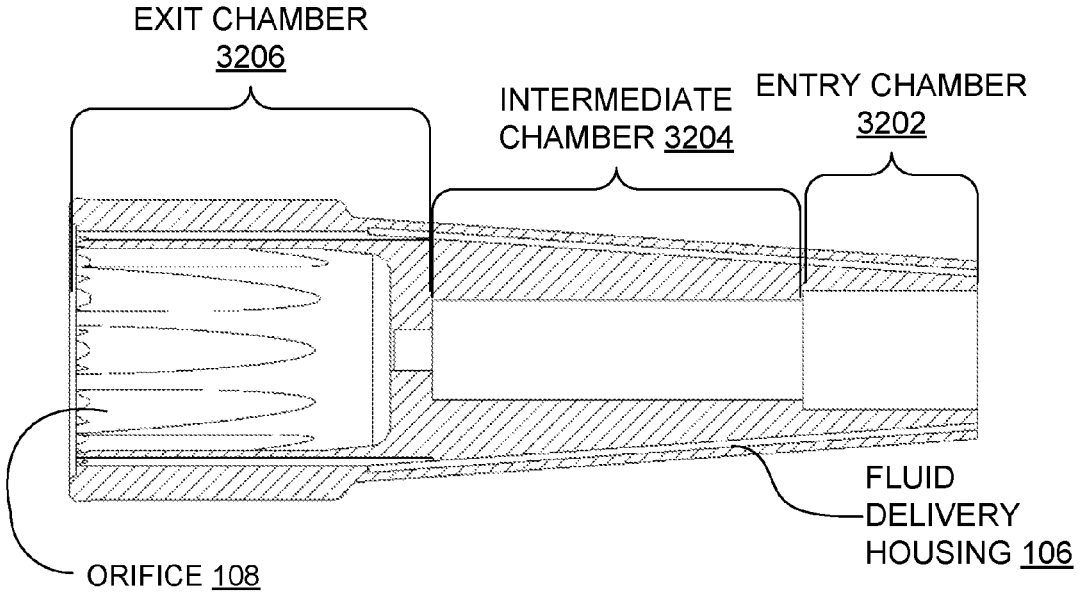
FIG. 32 is a cut-away side view of an isometric diagram of a pneumatic ported atomizing assembly, according to an implementation.

FIG. 32 is a cut-away side view of an isometric diagram of a pneumatic ported atomizing assembly 102, according to an implementation. The pneumatic ported atomizing assembly 102 consists of a fluid delivery housing 106. The fluid delivery housing 106 opens on one end with orifices(s) 108. The pneumatic ported atomizing assembly 102 includes an entry chamber 3202, an intermediate chamber 3204 and an exit chamber 3206.

Figure 33:
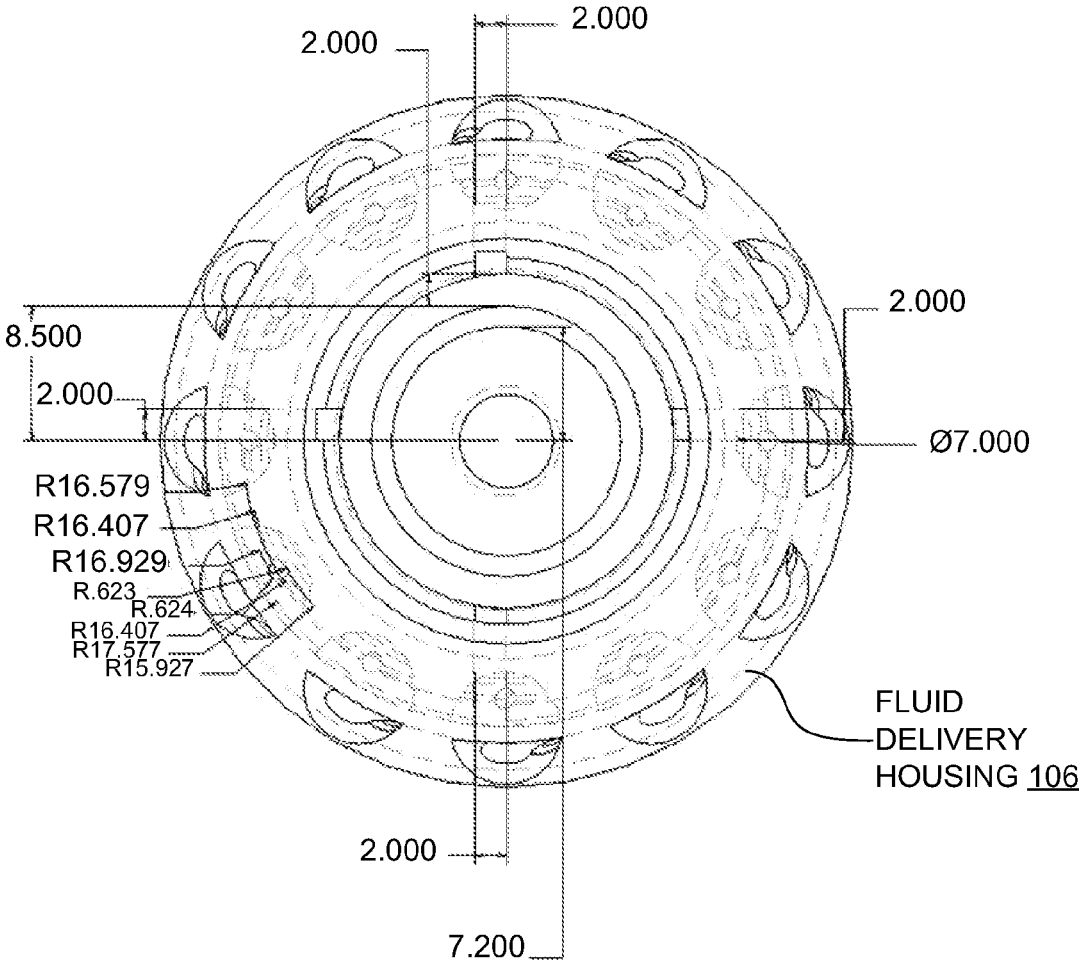
FIG. 33 is a rear view of an isometric diagram of a pneumatic ported atomizing assembly, according to an implementation.

FIG. 33 is a rear view of an isometric diagram of a pneumatic ported atomizing assembly 102, according to an implementation. The pneumatic ported atomizing assembly 102 consists of a fluid delivery housing 106. The fluid delivery housing 106 opens on one end with orifices(s) 108.

FIG. 34-38 are exploded views of a pneumatic ported atomizing assembly 102 for rotary spray gun in accordance with an implementation.

Figure 34:
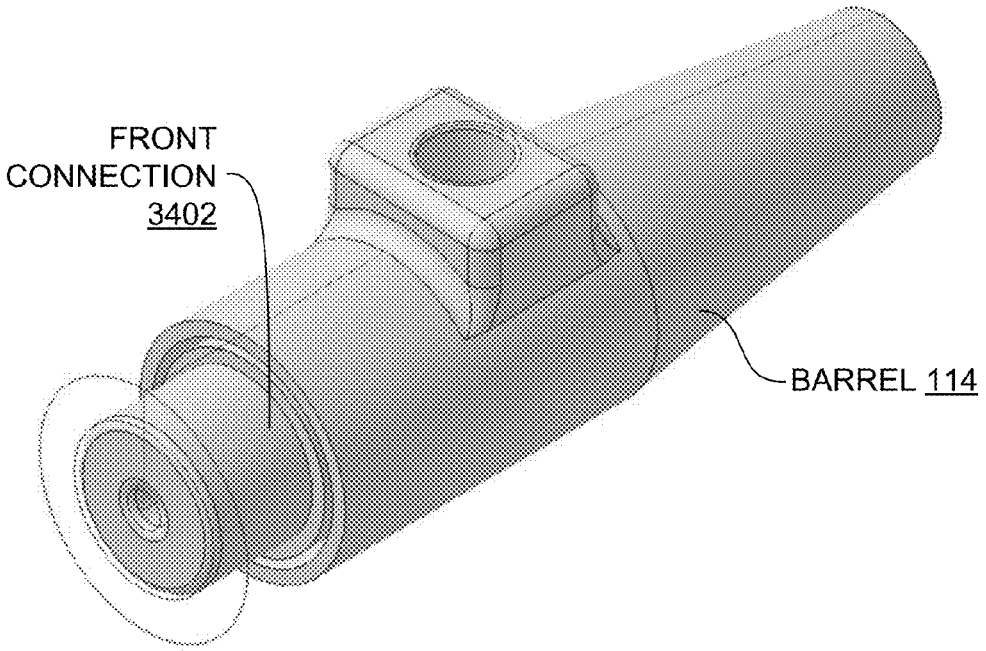
FIG. 34 is an isometric diagram of a pneumatic ported fluid delivery manifold, according to an implementation.

FIG. 34 is an isometric diagram of a pneumatic ported fluid delivery manifold 104, according to an implementation.

Figure 35:
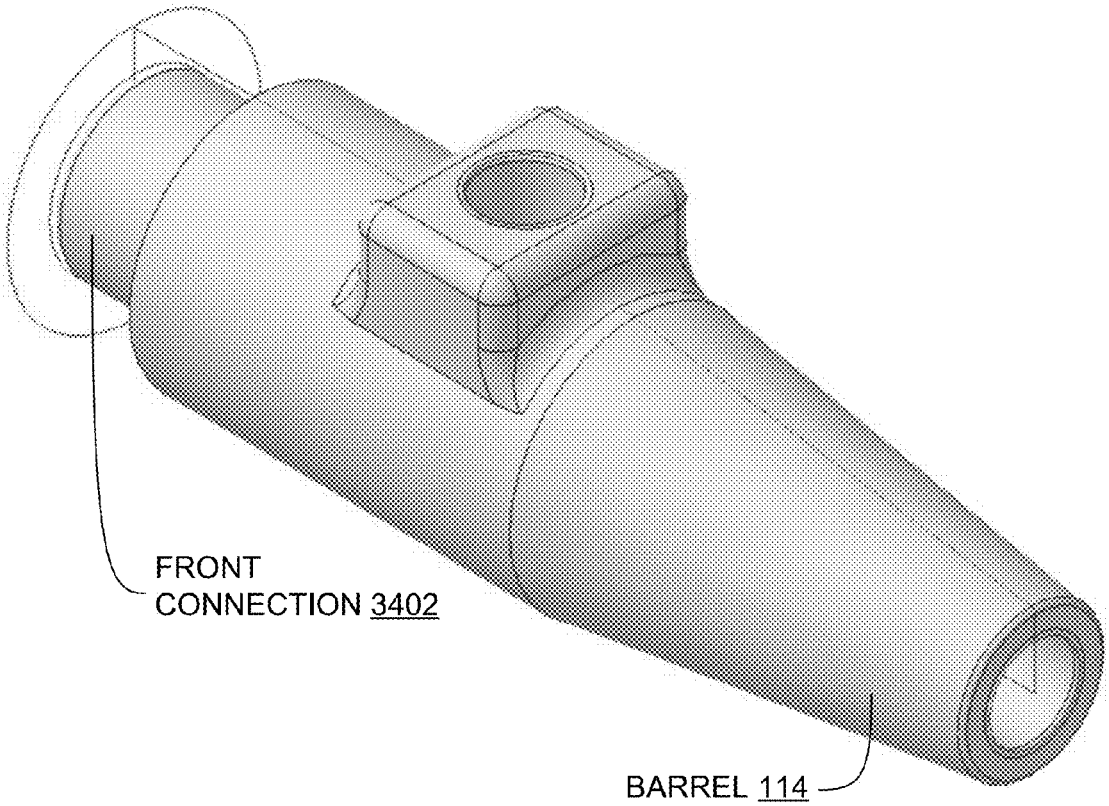
FIG. 35 is an isometric diagram of a pneumatic ported fluid delivery manifold, according to an implementation.

FIG. 35 is an isometric diagram of a pneumatic ported fluid delivery manifold 104, according to an implementation.

Figure 36:
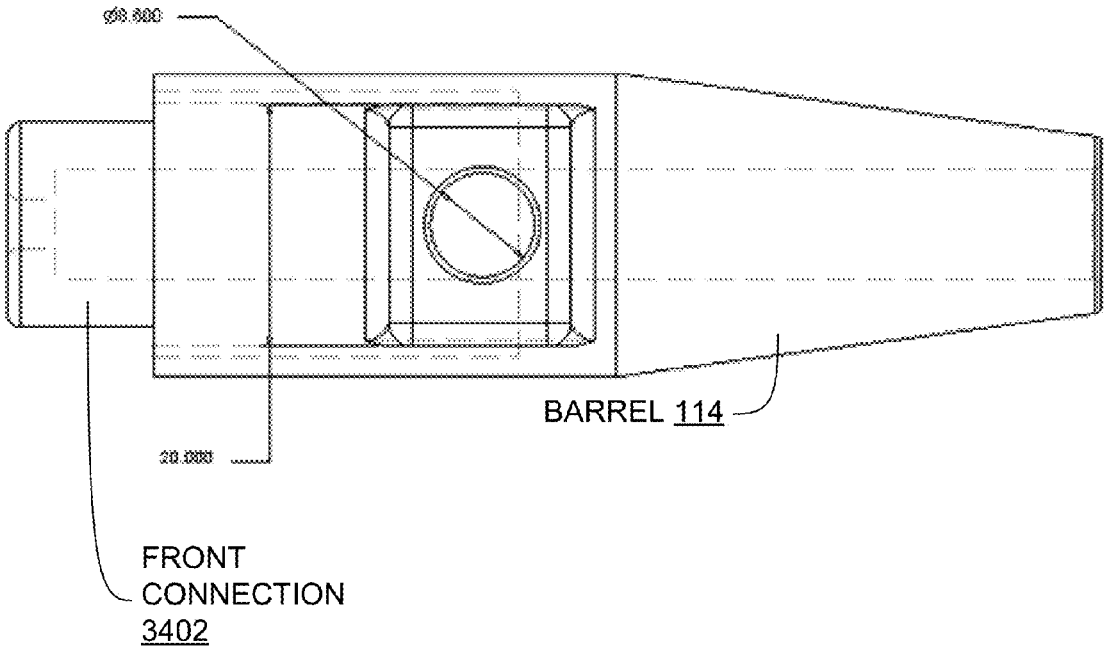
FIG. 36 is a top view of an isometric diagram of a pneumatic ported fluid delivery manifold, according to an implementation.

FIG. 36 is a top view of an isometric diagram of a pneumatic ported fluid delivery manifold 104, according to an implementation.

Figure 37:
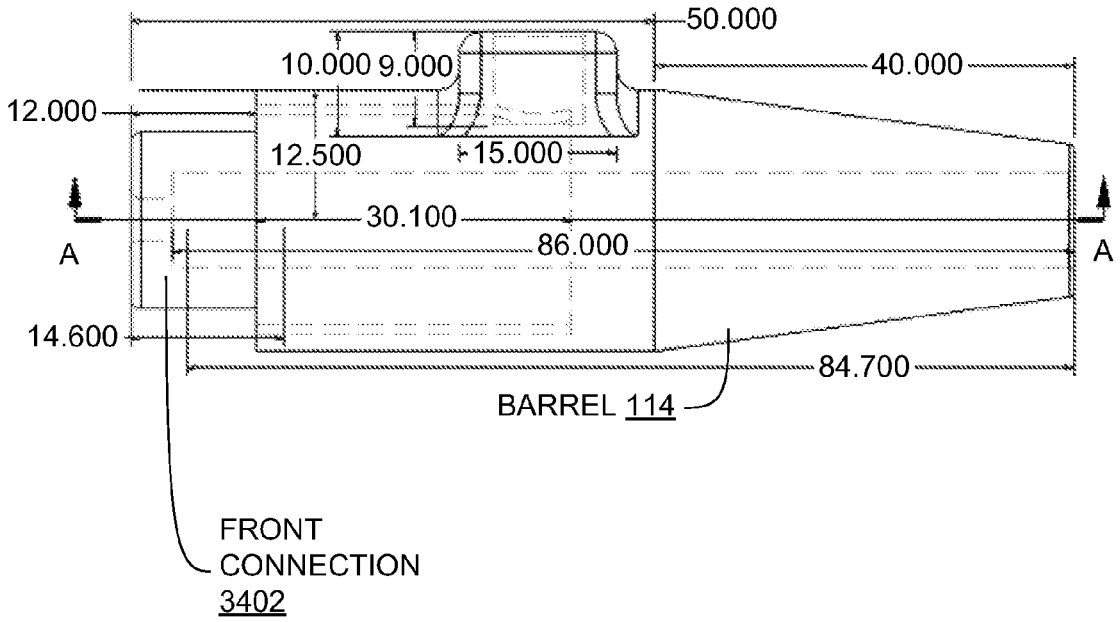
FIG. 37 is a side view of an isometric diagram of a pneumatic ported fluid delivery manifold, according to an implementation.

FIG. 37 is a side view of an isometric diagram of a pneumatic ported fluid delivery manifold 104, according to an implementation.

Figure 38:
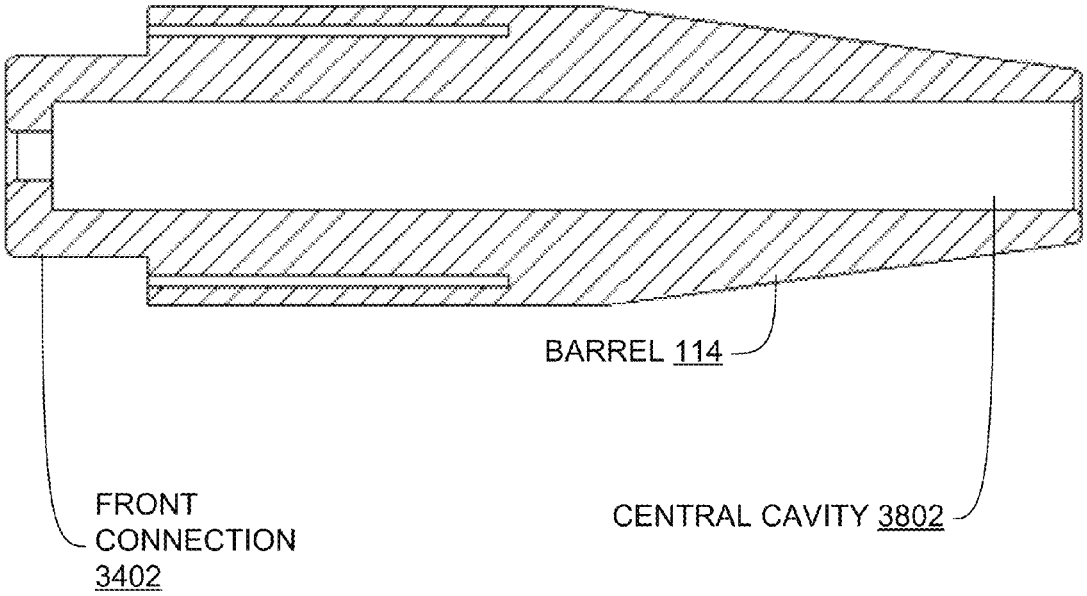
FIG. 38 is a cut-away bottom view of an isometric diagram of a pneumatic ported fluid delivery manifold, according to an implementation.

FIG. 38 is a cut-away bottom view of an isometric diagram of a pneumatic ported fluid delivery manifold 104, according to an implementation. The pneumatic ported fluid delivery manifold 104 includes a central cavity 3802 that extends through the entire pneumatic ported fluid delivery manifold 104 from one end to the opposite end.

Figure 39:
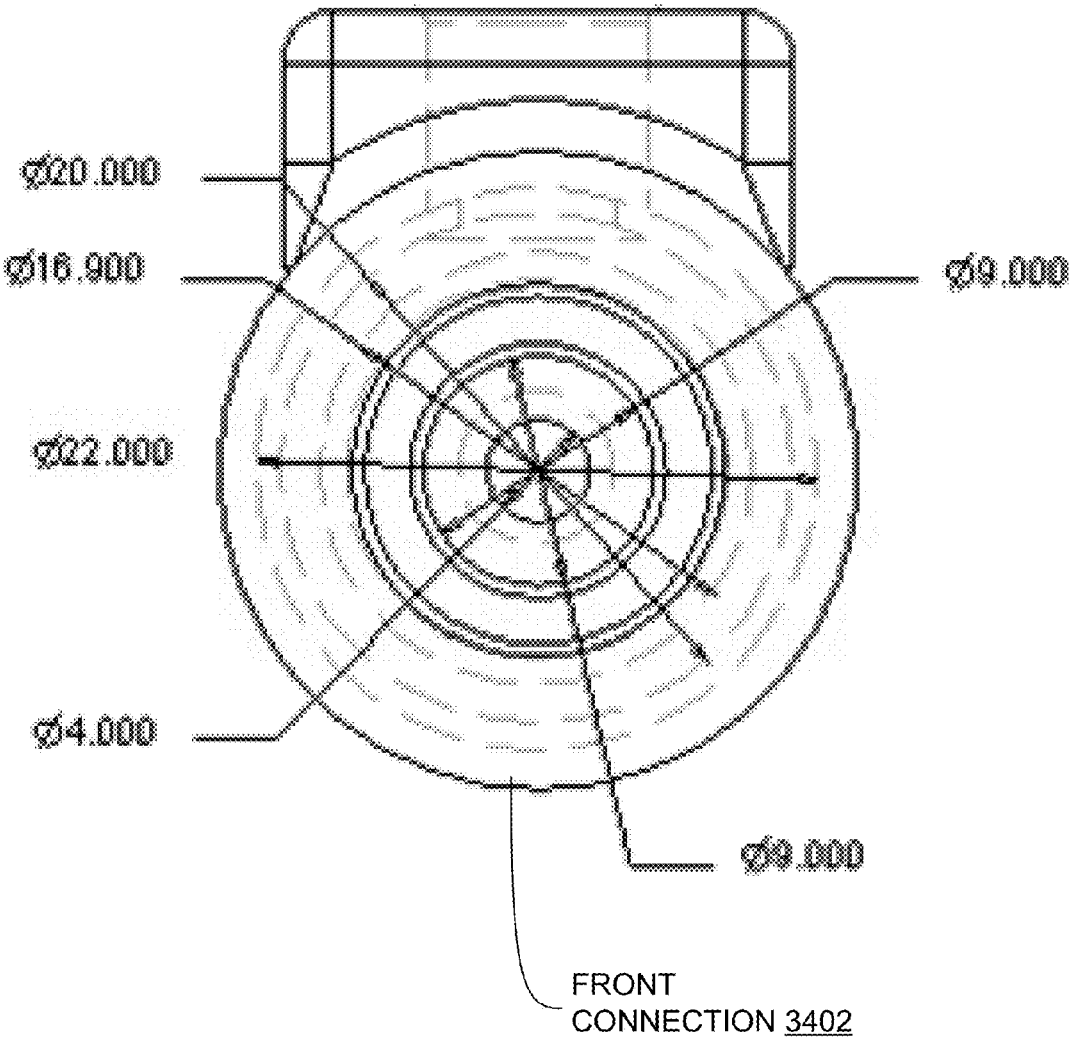
FIG. 39 is a rear view of an isometric diagram, according to an implementation.

FIG. 39 is a rear view of an isometric diagram of a pneumatic ported fluid delivery manifold 104, according to an implementation.

In some implementations of FIG. 1-39, the apparatus comprises essentially the apparatus shown in FIG. 1-39 and include no further aspects.

Method Implementations

In the previous section, apparatus of the operation of an implementation was described. In this section, the particular methods performed by a pneumatic ported atomizing fluid delivery manifold of such an implementation are described by reference to a series of flowcharts.

Figure 40:
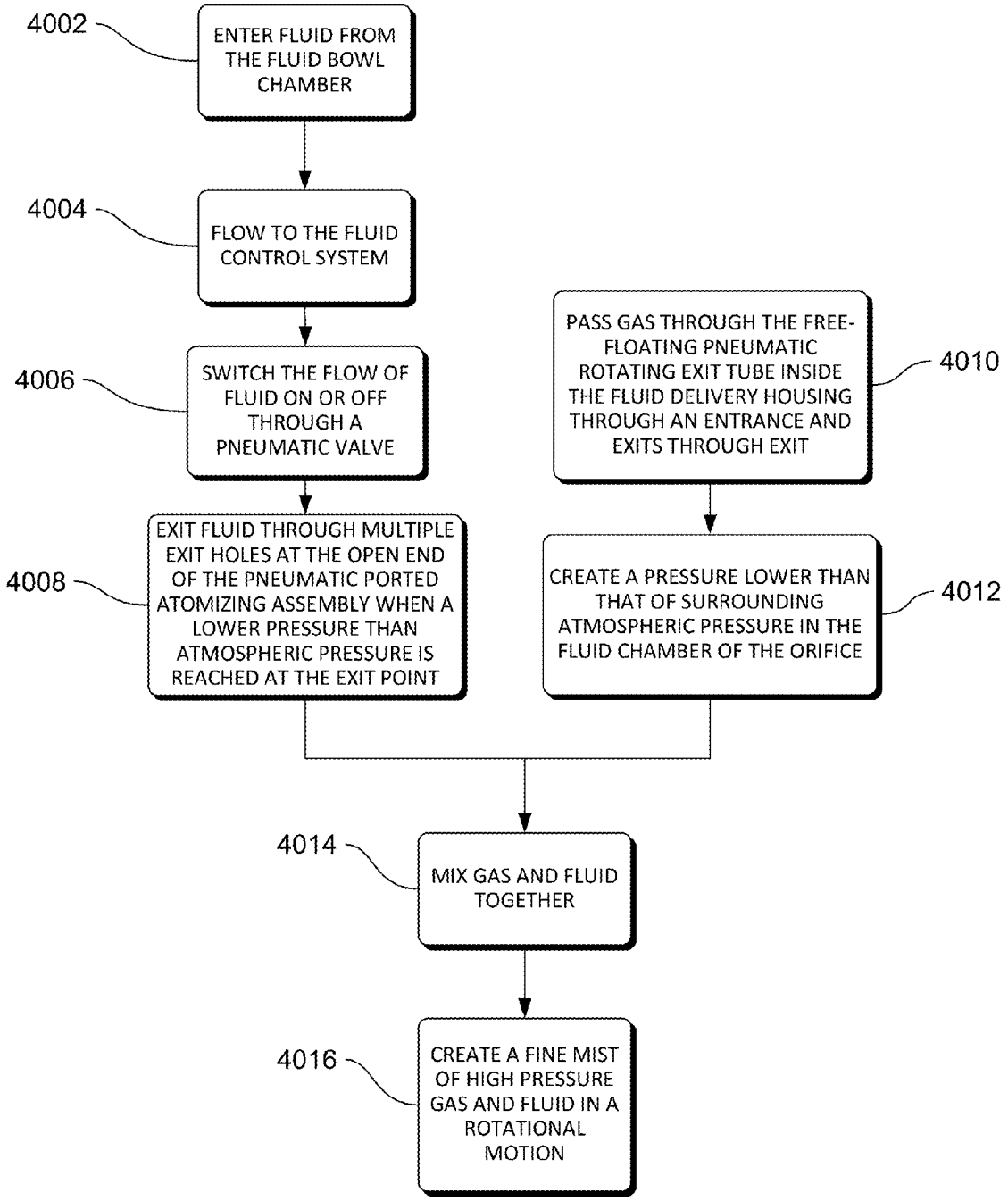
FIG. 40 is a flowchart of a method of a pneumatic ported atomizing fluid delivery manifold, according to an implementation.

FIG. 40 is a flowchart of a method 4000 of a pneumatic ported atomizing fluid delivery manifold, according to an implementation.

Method 4000 includes entering fluid from the fluid bowl-chamber 320, at block 4002.

Method 4000 also includes flowing the fluid to the fluid volume control device 322, at block 4004.

Method 4000 also includes switching the flow of the fluid on or off through a pneumatic valve 326, at block 4006.

Method 4000 also includes exiting fluid through multiple exit holes at the open end of the pneumatic ported atomizing assembly 102 when a lower pressure than atmospheric pressure is reached at the exit point, at block 4008.

Method 4000 also includes exiting gas through the free-floating pneumatic rotating exit tube 110 inside the fluid delivery housing 106 through an entrance 802 and through the exit 804, at block 4010, thus creating a pressure that is lower than that of surrounding atmospheric pressure in the fluid bowl-chamber 320 of the orifices(s) 108, at block 4012.

Method 4000 also includes mixing gas and fluid together, at block 4014.

Method 4000 also includes creating a fine mist of high pressure gas and fluid in a rotational motion, at block 4016.

CONCLUSION

A pneumatic ported atomizing fluid delivery manifold is described. Although specific implementations are illustrated and described herein, it will be appreciated by those of ordinary skill in the art that any arrangement which is calculated to achieve the same purpose may be substituted for the specific implementations shown. This application is intended to cover any adaptations or variations.

In particular, one of skill in the art will readily appreciate that the names of the methods and apparatus are not intended to limit implementations. Furthermore, additional methods and apparatus can be added to the components, functions can be rearranged among the components, and new components to correspond to future enhancements and physical devices used in implementations can be introduced without departing from the scope of implementations.

The invention claimed is:

1. A pneumatic ported atomizing fluid delivery manifold comprising:

a pneumatic ported fluid delivery manifold that comprises:

a barrel having a central cavity, the barrel being operable to attach to a gas source;

a gas/fluid delivery manifold formed out of walls of the pneumatic ported fluid delivery manifold of the barrel; and a volume control device that is mounted on an exterior of the gas/fluid delivery manifold that is operable to adjust an amount of a fluid that is delivered to the gas/fluid delivery manifold the fluid volume control device includes an intake orifice through which the fluid enters the fluid volume control device of the pneumatic ported atomizing fluid delivery manifold;

an apparatus that stores the fluid, the apparatus being connected to the fluid volume control device;

a pneumatic ported atomizing assembly operably coupled to the pneumatic ported fluid delivery manifold and that includes a fluid delivery housing and a free-floating pneumatic rotating exit tube, the fluid delivery housing having a hollow frustum geometry, the fluid delivery housing having a first end and a second end, the first end having a first plane and the second end having a second plane, the fluid delivery housing having a plurality of chambers through which the fluid is operable to pass from the first end to the second end; and the free-floating pneumatic rotating exit tube positioned along a longitudinal center axis of the fluid delivery housing and the free-floating pneumatic rotating exit tube having no inner fluid tube within the free-floating pneumatic rotating exit tube, the free-floating pneumatic rotating exit tube having only air passing through the free-floating pneumatic rotating exit tube, the free-floating pneumatic rotating exit tube having a curved nozzle tip;

wherein the gas/fluid delivery manifold in the pneumatic ported fluid delivery manifold provides a passageway to deliver the fluid to the plurality of chambers, wherein the plurality of chambers in the fluid delivery housing further comprises:

each of the plurality of chambers being positioned radially at a radius from the longitudinal center axis of the fluid delivery housing and symmetrically around the longitudinal center axis of the fluid delivery housing, wherein the plurality of chambers in the fluid delivery housing further comprises:

a gas/fluid delivery chamber;

a fluid bowl-chamber that is operably coupled to the gas/fluid delivery chamber, fluid bowl-chamber having exit holes;

a pneumatic valve that is fitted internally in the pneumatic ported atomizing assembly;

wherein a gas from the gas source passes through the central cavity of the pneumatic ported fluid delivery manifold and through a central cavity of the pneumatic ported atomizing assembly to the free-floating pneumatic rotating exit tube and out the curved nozzle tip of the free-floating pneumatic rotating exit tube, wherein an angle of the curved nozzle tip relative to the longitudinal center axis has an effect of exhausting the gas at an oblique angle to the longitudinal center axis which propels the free-floating pneumatic rotating exit tube in rotation, causing the gas to be expelled outward and backward from the second plane, wherein at the exit holes, the fluid from the exit holes and the gas from the free-floating pneumatic rotating exit tube are mixed together creating a fine mist of high pressure mixture of the gas and the fluid in a rotational motion, wherein a volume of the fluid from the gas/fluid delivery chamber to the fluid bowl-chamber can be switched on and off and varied by the pneumatic valve that is fitted internally in the pneumatic ported atomizing assembly and thus a force, speed and volume of the fluid from the exit holes can be switched on and off and varied by the pneumatic valve.

2. The pneumatic ported atomizing fluid delivery manifold of claim 1, wherein the plurality of chambers in the fluid delivery housing further comprises:

wherein at least one of the plurality of chambers is positioned above the center longitudinal axis to an extent that gravity is operable to draw a fluid out of the at least one of the plurality of chambers through the second end.

3. The pneumatic ported atomizing fluid delivery manifold of claim 1, wherein the frustum geometry further comprises:

a conical geometry.

4. The pneumatic ported atomizing fluid delivery manifold of claim 1, wherein the frustum geometry further comprises:

a triangular geometry.

5. The pneumatic ported atomizing fluid delivery manifold of claim 1, wherein the frustum geometry further comprises:

a square geometry.

6. The pneumatic ported atomizing fluid delivery manifold of claim 1, wherein the frustum geometry further comprises:

a pentagonal geometry.

7. The pneumatic ported atomizing fluid delivery manifold of claim 1, wherein the frustum geometry further comprises:

a linear frustum geometry.

8. The pneumatic ported atomizing fluid delivery manifold of claim 1, wherein the frustum geometry further comprises:

a curved frustum geometry.

9. The pneumatic ported atomizing fluid delivery manifold of claim 1, wherein the frustum geometry further comprises:

a bent frustum geometry in which the first plane of the first end is not parallel with the second plane of the second end.

* * * * *